US012376648B2

(12) United States Patent
Cooper

(10) Patent No.: US 12,376,648 B2
(45) Date of Patent: Aug. 5, 2025

(54) ARTICLE OF FOOTWEAR INCLUDING LACE-ENGAGING SLOTS AND FOOT WRAPPING BANDS

(71) Applicant: NIKE, Inc., Beaverton, OR (US)

(72) Inventor: Aaron Cooper, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/310,681

(22) Filed: May 2, 2023

(65) Prior Publication Data

US 2023/0263268 A1 Aug. 24, 2023

Related U.S. Application Data

(63) Continuation of application No. 17/166,651, filed on Feb. 3, 2021, now Pat. No. 11,672,305, which is a (Continued)

(51) Int. Cl.
*A43B 23/07* (2006.01)
*A43B 7/14* (2022.01)
(Continued)

(52) U.S. Cl.
CPC ..... *A43B 23/0265* (2013.01); *A43B 7/1495* (2013.01); *A43B 13/023* (2013.01);
(Continued)

(58) Field of Classification Search
CPC ..... A43B 23/07; A43B 7/1495; A43B 7/28; A43C 1/003; A43C 1/00
(Continued)

(56) References Cited

U.S. PATENT DOCUMENTS 1,463,278 A 7/1923 David
1,603,144 A 10/1926 Nichols
(Continued)

FOREIGN PATENT DOCUMENTS

CN 101267752 A 9/2008
CN 101909471 A 12/2010
(Continued)

OTHER PUBLICATIONS

Feb. 4, 2022—(EP) ESR—App. No. 21204780.7.
(Continued)

*Primary Examiner* — Marie D Bays
(74) *Attorney, Agent, or Firm* — Banner & Witcoff, Ltd.

(57) ABSTRACT

Footwear includes an exterior upper component having a lace-engaging region with medial and lateral side edges. A medial lace engaging slot is defined through the exterior upper component at the medial side edge, and a lateral lace engaging slot is defined through the exterior upper component at the lateral side edge. A medial side foot wrapping band is fixed to a plantar support component and extends inside the exterior upper component toward the medial side edge of the lace-engaging region, and a lateral side foot wrapping band is fixed to the plantar support component and extends inside the exterior upper component toward the lateral side edge of the lace-engaging region. Each of the medial and lateral side foot wrapping bands includes a lace engaging element. A lace engages the medial lace engaging slot, the medial lace engaging element, the lateral lace engaging slot, and the lateral lace engaging element.

20 Claims, 15 Drawing Sheets

Related U.S. Application Data continuation of application No. 16/116,353, filed on Aug. 29, 2018, now Pat. No. 10,945,491.

(60) Provisional application No. 62/552,542, filed on Aug. 31, 2017.

(51) Int. Cl.

| | |
|---|---|
| ***A43B 13/02*** | (2022.01) |
| ***A43B 19/00*** | (2006.01) |
| ***A43B 23/02*** | (2006.01) |
| ***A43C 1/04*** | (2006.01) |

(52) U.S. Cl.

CPC ..... *A43B 19/00* (2013.01); *A43B 23/0235* (2013.01); *A43B 23/0245* (2013.01); *A43B 23/026* (2013.01); *A43B 23/07* (2013.01); *A43C 1/04* (2013.01)

(58) Field of Classification Search

USPC ..... 36/25 R

See application file for complete search history.

(56) References Cited

U.S. PATENT DOCUMENTS 1,976,819 A * 10/1934 Weiler ..... A43B 7/1495 36/166
2,345,057 A 3/1944 Gioseph
2,539,761 A * 1/1951 Whitman ..... A43C 1/00 36/114
2,798,309 A * 7/1957 Wustemann ..... A43B 7/1495 602/66
3,091,871 A 6/1963 Tronche
3,191,321 A 6/1965 Brutting
3,323,232 A * 6/1967 Danowsky ..... A43B 7/1495 36/76 R
4,592,154 A * 6/1986 Oatman ..... A43B 5/00 36/114
4,811,500 A * 3/1989 Maccano ..... A43B 5/00 36/91
4,860,464 A * 8/1989 Misevich ..... A43B 7/1495 36/114
4,899,466 A * 2/1990 Skaja ..... A43C 1/00 24/713.2
4,916,833 A * 4/1990 Nwoko ..... A43C 5/00 24/712.2
4,955,147 A 9/1990 Bos
5,214,863 A * 6/1993 Skaja ..... A43C 1/00 24/713.2
5,259,126 A 11/1993 Rosen
5,319,869 A * 6/1994 McDonald ..... A43B 5/00 36/114
5,454,172 A 10/1995 Crigger
5,499,459 A 3/1996 Tomaro
5,678,329 A 10/1997 Griffin et al.
5,692,319 A 12/1997 Parker et al.
5,775,006 A 7/1998 Breuner
5,784,808 A 7/1998 Hockerson
5,907,912 A 6/1999 Alaimo
5,992,057 A * 11/1999 Monti ..... A43B 7/1495 36/89
6,453,579 B1 9/2002 Luprete
6,467,193 B1 10/2002 Okajima
6,925,734 B1 8/2005 Schaeffer
D517,297 S 3/2006 Jones et al.
7,047,668 B2 5/2006 Burris et al.
7,073,279 B2 7/2006 Min
7,086,181 B2 8/2006 Farys
7,434,336 B2 10/2008 Kosted
8,061,059 B2 * 11/2011 Bruce ..... A43B 13/143 36/31
8,161,666 B2 4/2012 Liles
8,479,415 B2 7/2013 Berger et al.
8,578,632 B2 11/2013 Bell et al.
8,869,435 B2 10/2014 Hatfield et al.
8,973,410 B1 3/2015 Podhajny
9,107,474 B2 8/2015 Farris et al.
9,192,204 B1 11/2015 Liles et al.
9,210,966 B2 12/2015 Bell et al.
9,414,638 B2 8/2016 Hatfield et al.
9,565,898 B2 2/2017 Mahoney
9,609,908 B2 4/2017 Bell et al.
9,763,495 B2 9/2017 Takada et al.
9,770,065 B2 9/2017 Bell et al.
9,839,259 B2 12/2017 Arquilla
10,051,918 B2 8/2018 Dombrow et al.
10,362,832 B2 7/2019 Bell et al.
10,405,606 B2 9/2019 Farris et al.
10,945,491 B2 3/2021 Cooper
11,083,248 B2 8/2021 Schneider et al.
11,122,853 B2 9/2021 Smith et al.
11,206,898 B2 12/2021 Cobb
11,672,305 B2 6/2023 Cooper
2002/0148142 A1 * 10/2002 Oorei ..... A43B 23/0255 36/129
2006/0101669 A1 5/2006 Santos
2006/0123663 A1 6/2006 Swensen
2007/0000150 A1 1/2007 Covatch
2007/0011910 A1 1/2007 Keen
2007/0062067 A1 3/2007 Covatch
2007/0227037 A1 10/2007 Kao
2009/0100713 A1 4/2009 Adami et al.
2010/0071230 A1 3/2010 Hassid et al.
2011/0016749 A1 1/2011 Callahan et al.
2011/0197475 A1 * 8/2011 Weidl ..... A43B 23/0235 36/107
2012/0011744 A1 1/2012 Bell et al.
2012/0030965 A1 2/2012 Greene et al.
2012/0246973 A1 * 10/2012 Dua ..... A43B 23/0255 36/83
2012/0304493 A1 12/2012 Hudson et al.
2013/0104422 A1 5/2013 Hatfield et al.
2014/0090274 A1 4/2014 Arquilla
2014/0202042 A1 * 7/2014 Berend ..... A43C 13/04 36/25 R
2015/0121724 A1 5/2015 Sung
2015/0150339 A1 6/2015 Van Hook
2015/0257475 A1 9/2015 Langvin et al.
2015/0257476 A1 9/2015 Panian et al.
2016/0058100 A1 3/2016 Dealey et al.
2016/0066647 A1 3/2016 Handorf
2016/0088901 A1 3/2016 Mahoney
2016/0302513 A1 10/2016 Bell et al.
2016/0331083 A1 11/2016 Uesato
2017/0027272 A1 2/2017 Yeglinski, II
2017/0127760 A1 5/2017 Arquilla
2017/0181501 A1 6/2017 Gautier et al.
2017/0231324 A1 8/2017 Arquilla et al.
2017/0265560 A1 9/2017 Beers et al.
2017/0273404 A1 9/2017 Doenges et al.
2018/0343966 A1 12/2018 Cook et al.
2018/0360167 A1 12/2018 Zoulamian
2019/0082792 A1 * 3/2019 Cooper ..... A43B 23/0245
2019/0246742 A1 8/2019 Cooper
2019/0246743 A1 8/2019 Cooper
2019/0274392 A1 9/2019 Amis et al.
2019/0307209 A1 10/2019 Houng et al.
2019/0350314 A1 11/2019 Pauk et al.
2020/0046076 A1 2/2020 Walker
2022/0132995 A1 5/2022 Rhulen et al.
2023/0255318 A1 8/2023 Cooper

FOREIGN PATENT DOCUMENTS

CN 105495845 A 4/2016
CN 106136453 A 11/2016
EP 0570621 A1 11/1993
FR 1332097 A 12/1963
FR 2501977 B3 2/1983

(56) References Cited

FOREIGN PATENT DOCUMENTS

| | | | |
|---|---|---|---|
| GB | 465012 | A | 4/1937 |
| GB | 2465973 | B | 1/2013 |
| KR | 101902109 | B1 | 9/2018 |

OTHER PUBLICATIONS

Dec. 12, 2018 (WO) International Search Report—App. PCT/US2018/048485, 21 pages.
Army Dark Gum Trainer+ (Men's) $139.00, nobullproject.com, Mar. 13, 2023, 7 pages.
Chuck Taylor All Star Lugged 2.0 Rugged Basics, converse.com, <<https://www.converse.com/shop/p/chuck-taylor-all-star-lugged-2.0-rugged-basics-unisex-high-top-shoe/A05124C_085.html . . . >>, Mar. 13, 2023, 7 pages.
Kapalua Men's Golf Shoes—Poi, <<https://olukai.com/products/kapalua-mens-golf-shoes-poi-charcoal?currency=USD . . . >>, Mar. 10, 2023, 5 pages.
Pro/SL Sport Women/Breathable Waterproof Golf Shoe, FootJoy, <<https://www.footjoy.com/women/golf-shoes/spikeless/pro%7Csl-sport-women . . . >>, Mar. 10, 2023, 8 pages.
W Gaviota 4, <<https://berkshirerunningcenter.com/w-gaviota/>>, Mar. 13, 2023, 3 pages.

* cited by examiner

ARTICLE OF FOOTWEAR INCLUDING LACE-ENGAGING SLOTS AND FOOT WRAPPING BANDS

RELATED APPLICATION DATA

This application: (a) is a continuation of co-pending U.S. patent application Ser. No. 17/166,651 filed Feb. 3, 2021, which application (b) is a continuation of U.S. patent application Ser. No. 16/116,353 filed Aug. 29, 2018 (now U.S. Pat. No. 10,945,491 B2 granted Mar. 16, 2021), which application (c) is a non-provisional of U.S. Provisional Patent Appln. No. 62/552,542 filed Aug. 31, 2017 and entitled "Articles of Footwear and Other Foot-Receiving Devices." Each of U.S. patent application Ser. No. 17/166,651, U.S. patent application Ser. No. 16/116,353, and U.S. Provisional Patent Appln. No. 62/552,542 is entirely incorporated herein by reference.

FIELD OF THE INVENTION

The present invention relates to the field of footwear or other foot-receiving devices, e.g., including various conforming fit, stability, and/or "locked down" feel features.

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces). The upper also may include a heel counter to limit or control movement of the heel.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, etc.), and the like. "Foot-receiving device," as that term is used herein, means any device into which a user places at least some portion of his or her foot. In addition to all types of "footwear," foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include: (a) one or more "foot-covering members" (e.g., akin to footwear upper components), which help position the foot with respect to other components or structures, and (b) one or more "foot-supporting members" (e.g., akin to footwear sole structure components), which support at least some portion (s) of a plantar surface of a user's foot. "Foot-supporting members" may include components for and/or functioning as midsoles and/or outsoles for articles of footwear (or components providing corresponding functions in non-footwear type foot-receiving devices).

SUMMARY OF THE INVENTION

This Summary is provided to introduce some general concepts relating to this invention in a simplified form that are further described below in the Detailed Description. This Summary is not intended to identify key features or essential features of the invention.

Aspects of this invention relate to the field of footwear or other foot-receiving devices, e.g., including various conforming fit, stability, and/or "locked down" feel features. Such articles of footwear and/or other foot-receiving devices may include any one or more structures, parts, features, properties, and/or combination(s) of structures, parts, features, and/or properties of the examples described and/or claimed below and/or of the examples illustrated in the appended drawings.

While some aspects of the invention may be described in terms of articles of footwear, additional aspects of this invention relate to other foot-receiving devices, methods of making such articles of footwear and/or foot-receiving devices, and/or methods of using such articles of footwear and/or foot-receiving devices.

BRIEF DESCRIPTION OF THE DRAWINGS

The foregoing Summary of the Invention, as well as the following Detailed Description of the Invention, will be better understood when considered in conjunction with the accompanying drawings in which like reference numerals refer to the same or similar elements in all of the various views in which that reference number appears.

DETAILED DESCRIPTION OF THE INVENTION

Figure 1A:
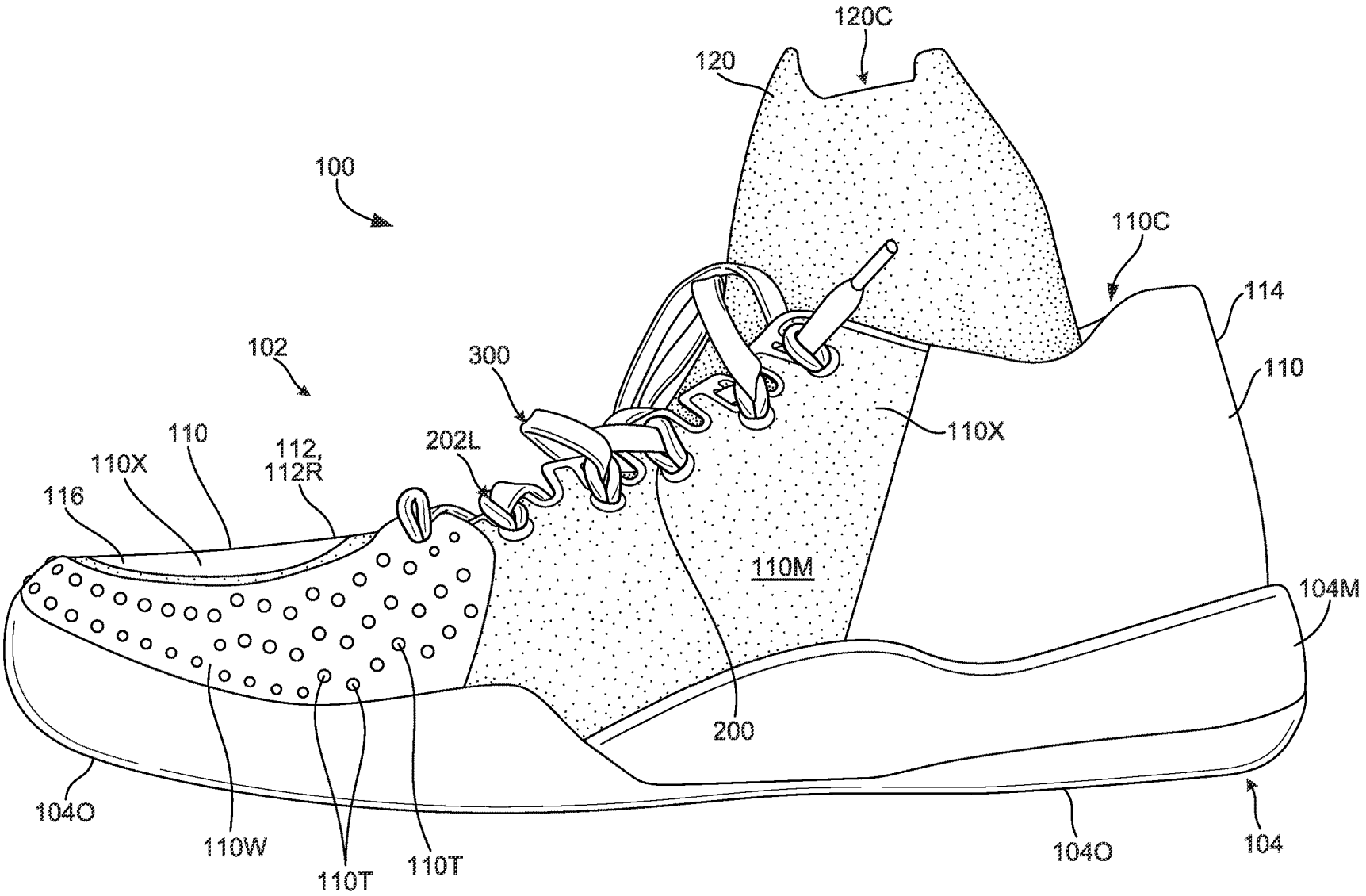
FIGS. 1A-1F provide various views of example articles of footwear and/or upper components in accordance with at least some aspects of this invention.

In the following description of various examples of footwear structures and components according to aspects of the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made to the specifically described structures and methods without departing from the scope of the present invention.

I. General Description of Aspects of this Invention

As noted above, aspects of this invention relate to the field of footwear or other foot-receiving devices, e.g., including various conforming fit, stability, and/or "locked down" feel features.

Some aspects of this invention relate to uppers (or foot-covering components) for articles of footwear (or other foot-receiving devices) that include: (a) an upper shell defining an interior chamber, wherein the upper shell includes a plantar support surface and sidewalls extending upward from an outer perimeter of the plantar support surface; and (b) a bootie component (which may be formed as a sock or sock-like garment that optionally fits tightly to and/or conforms in shape to a wearer's foot) received in the interior chamber. In at least some examples of this aspect of the invention, the bootie component may be fixedly engaged with the upper shell at fixed connections that include (and optionally consist essentially of):

(a) one or more fixed bottom connections between the bootie component (e.g., its bottom surface) and the plantar support surface of the upper shell, wherein the one or more fixed bottom connections is/are spaced inward (e.g., at least 6 mm) from the outer perimeter of the plantar support surface, and (b) one or more fixed top connections between the bootie component and a top forefoot area of the upper shell, wherein each of the one or more fixed top connections is located within a fixed region having: (i) a width dimension of less than 5 cm in a medial side-to-lateral side direction of the upper and a length dimension of less than 2 cm in a heel-to-toe direction of the upper and/or (ii) a fixed area of less than 10 $cm^2$.

Some additional or alternative aspects of this invention relate to uppers (or foot-covering components) for articles of footwear (or other foot-receiving devices) that include: (a) an upper shell defining an interior chamber and a lace engaging region, wherein the upper shell includes a plantar support surface and sidewalls extending upward from an outer perimeter of the plantar support surface; and (b) a bootie component (which may be formed as a sock or sock-like garment that optionally fits tightly to and/or conforms in shape to a wearer's foot) received in the interior chamber. In at least some examples of this aspect of the invention:

(a) a bottom of the bootie component is fixedly engaged with the plantar support surface by one or more fixed bottom connections between the bootie component and the plantar support surface of the upper shell, wherein the one or more fixed bottom connections is/are spaced inward (e.g., at least 6 mm) from the outer perimeter of the plantar support surface, (b) a top of the bootie component is fixedly engaged with a top forefoot area of the upper shell at a fixed region located proximate to a forward edge of the lace engaging region, wherein the fixed region includes one or more fixed top connections between the bootie component and the top forefoot area of the upper shell, and wherein the fixed region has: (i) a width dimension of less than 5 cm in a medial side-to-lateral side direction of the upper and a first length dimension of less than 2 cm in a heel-to-toe direction of the upper and/or (b) a fixed area of less than 10 $cm^2$, (c) the top of the bootie component is not fixedly engaged with the top forefoot area of the upper shell at a non-fixed region located forward of the fixed region, wherein the non-fixed region has: (i) a second length dimension of at least 2 cm in the heel-to-toe direction of the upper and/or (ii) a non-fixed area of at least 10 $cm^2$, (d) the bootie component is not fixedly engaged with a medial side of the upper shell (optionally, at least along a midfoot region of the upper shell), and/or (e) the bootie component is not fixedly engaged with a lateral side of the upper shell (optionally, at least along a midfoot region of the upper shell).

In this manner, the bootie component may be substantially decoupled from the upper shell, e.g., at least along the sides of the bootie component/upper shell/upper.

Still some additional or alternative aspects of this invention relate to uppers (or foot-covering components) for articles of footwear (or other foot-receiving devices) that include: (a) a medial sidewall; (b) a lateral sidewall; (c) a top panel engaged with or integrally formed with at least one of the medial sidewall and the lateral sidewall, wherein the medial sidewall, the lateral sidewall, and the top panel at least partially define a lace engaging region of the upper having a medial side edge, a lateral side edge, and a forward edge; (d) a bottom base (also called a "plantar support surface" herein) including an outer perimeter edge, wherein a medial side of the outer perimeter edge is engaged or integrally formed with the medial sidewall, wherein a lateral side of the outer perimeter edge is engaged or integrally formed with the lateral sidewall, and wherein the medial sidewall, the lateral sidewall, the top panel, and the bottom base define an interior chamber; and (e) a bootie component (which may be formed as a sock or sock-like garment that optionally fits tightly to and/or conforms in shape to a wearer's foot) received in the interior chamber. In at least some examples of this aspect of the invention:

(a) a bottom of the bootie component is fixedly engaged with the bottom base by stitching and/or adhesive formed as a closed loop and/or spaced inward from the outer perimeter edge, (b) a top of the bootie component is fixedly engaged with the top panel at a fixed region located proximate to the forward edge of the lace engaging region, wherein the fixed region has: (i) a width dimension of less than 5 cm in a medial side-to-lateral side direction of the upper and a first length dimension of less than 2 cm in a heel-to-toe direction of the upper and/or (ii) a fixed area of less than 10 $cm^2$, (c) the top of the bootie component is not fixedly engaged with the top panel at a non-fixed region located forward of the fixed region, wherein the non-fixed region has: (i) a second length dimension of at least 2 cm in the heel-to-toe direction of the upper and/or a non-fixed area of at least 10 $cm^2$, (d) the bootie component is not fixedly engaged with the medial sidewall, and/or (e) the bootie component is not fixedly engaged with the lateral sidewall.

In this manner, the bootie component may be substantially decoupled from the upper shell, e.g., at least along the sides of the bootie component/upper shell/upper.

Additional or alternative aspects of this invention relate to uppers (or foot-covering components) for articles of footwear (or other foot-receiving devices) that include one or more foot wrapping bands (e.g., on the medial side and/or the lateral side of the upper or foot-covering component). The foot wrapping band(s) may include:

a first medial side foot wrapping band that includes: (a) a first medial lace engaging element, (b) a first medial band segment extending from the first medial lace engaging element and optionally between an upper shell and a bootie component of the upper, wherein the first medial band segment is engaged with a plantar support surface of the upper (e.g., an upper shell) at a fixed bottom connection spaced inward from an outer perimeter of the plantar support surface, and (c) a second medial band segment extending from the first medial lace engaging element and optionally between an upper shell and a bootie component of the upper, wherein the second medial band segment extends forward of the first medial band segment and is engaged with a plantar support surface of the upper (e.g., an upper shell) at a fixed bottom connection spaced inward from an outer perimeter of the plantar support surface; and/or a first lateral side foot wrapping band that includes: (a) a first lateral lace engaging element, (b) a first lateral band segment extending from the first lateral lace engaging element and optionally between an upper shell and a bootie component of an upper, wherein the first lateral band segment is engaged with a plantar support surface of the upper (e.g., an upper shell) at a fixed bottom connection spaced inward from an outer perimeter of the plantar support surface, and (c) a second lateral band segment extending from the first lateral lace engaging element and optionally between an upper shell and a bootie component of the upper, wherein the second lateral band segment extends forward of the first lateral band segment and is engaged with a plantar support surface of the upper (e.g., an upper shell) at a fixed bottom connection spaced inward from an outer perimeter of the plantar support surface.

Optionally, at least one of the first medial band segment, the second medial band segment, the first lateral band segment, and/or the second lateral band segment will have a thin, flat band structure, e.g., less than 5 mm thick, and in some examples, less than 4 mm thick or even less than 3 mm thick. As some more specific examples, at least one of the first medial band segment, the second medial band segment, the first lateral band segment, and/or the second lateral band segment will have a longitudinal length L, a width W, and a thickness T, wherein:

$T \geq 1$ mm, $W \geq 3T$, and $L \geq 10$ W.

Uppers (or foot-covering components) according to aspects and/or examples of the invention having foot wrapping bands may include any desired number of foot wrapping bands on the medial side (e.g., from 1 to 10, and in some examples a plurality of such medial foot wrapping bands, e.g., from 2 to 8 or even from 2 to 6) and/or any desired number of foot wrapping bands on the lateral side (e.g., from 1 to 10, and in some examples, a plurality of such lateral foot wrapping bands, e.g., from 2 to 8 or even from 2 to 6). Any one or more of these foot wrapping bands may have the longitudinal length, width, and/or thickness dimensional features described above. When two or more of the foot wrapping bands are provided on one side of the upper/foot-covering component, segments of the foot wrapping bands (e.g., segments of adjacent foot wrapping bands) may cross one another. The foot wrapping band(s) may form a "V" shaped configuration, e.g., to contain and/or support a side of the wearer's foot, e.g., in which the vertex of the "V" shape constitutes the lace engaging element.

Additionally or alternatively, uppers/foot-covering components according to at least some aspects of this invention may include one or both of:

a rearmost medial side foot wrapping band that includes: (a) a medial lace engaging element, (b) a rearward extending medial band segment extending from the medial lace engaging element and optionally between an upper shell and a bootie component of the upper, wherein the rearward extending medial band segment is engaged with a rear heel area of the upper (e.g., with a rear heel area of a bootie component), and (c) another medial band segment extending from the medial lace engaging element and optionally between an upper shell and a bootie component of the upper, wherein this other medial band segment extends forward of the rearward extending medial band segment and is engaged with a plantar support surface of the upper (e.g., an upper shell) at a fixed bottom connection spaced inward from an outer perimeter of the plantar support surface; and/or a rearmost lateral side foot wrapping band that includes: (a) a lateral lace engaging element, (b) a rearward extending lateral band segment extending from the lateral lace engaging element and optionally between an upper shell and a bootie component of the upper, wherein the rearward extending lateral band segment is engaged with a rear heel area of the upper (e.g., with a rear heel area of a bootie component), and (c) another lateral band segment extending from the lateral lace engaging element and optionally between an upper shell and a bootie component of the upper, wherein this other lateral band segment extends forward of the rearward extending lateral band segment and is engaged with a plantar support surface of the upper (e.g., an upper shell) at a fixed bottom connection spaced inward from an outer perimeter of the plantar support surface.

The rearmost foot wrapping band(s) may form a "V" shaped configuration, e.g., to contain and/or support a side and/or heel area of a wearer's foot, e.g., in which the vertex of the "V" shape constitutes the lace engaging element. Either or both of these rearmost foot wrapping bands may have any of the various dimensional, shape, and/or structural features described above for the other foot wrapping bands.

Uppers and/or foot-covering components in accordance with still additional or other alternative aspects of this invention may include an interior compartment defined by the bootie component configured to completely contain a wearer's foot (e.g., akin to a sock like structure), wherein the upper further comprises an interior midsole received in the interior compartment of the bootie component, wherein the interior midsole includes a plantar support surface and is made from a polymer foam material. This interior midsole, when present, may define a longitudinal direction extending from a rearmost heel location to a forwardmost toe location, wherein along the longitudinal direction, a thickest dimension of the interior midsole along the longitudinal direction may be located in a forward heel and/or an arch support area of the interior midsole. This interior midsole may be removably received in the interior compartment of the upper/foot-covering component (e.g., inside the bootie component and/or closest to a plantar surface of a wearer's foot).

Additional aspects of this invention relate to articles of footwear (or other foot-receiving devices) that include uppers (or foot-covering components) according to any of the aspects of the invention described above (or those described in more detail below) and a sole structure (or other foot-supporting component) engaged with the upper (or foot-covering component).

Given the general description of example features, aspects, structures, and arrangements according to certain embodiments of the invention provided above, a more detailed description of specific example footwear upper structures, articles of footwear, foot-receiving devices, and methods in accordance with this invention follows.

Figure 1B:
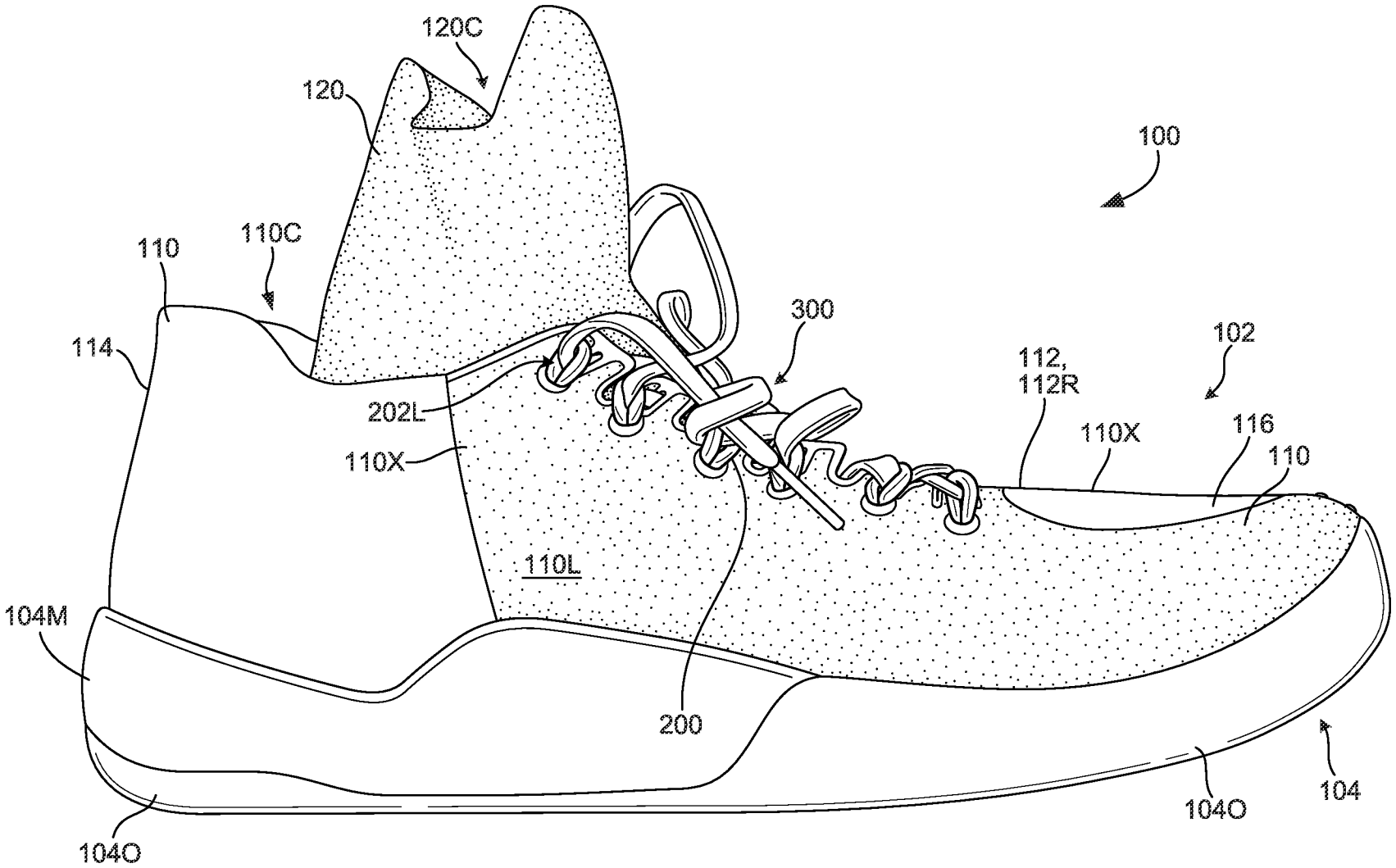
Figure 1C:
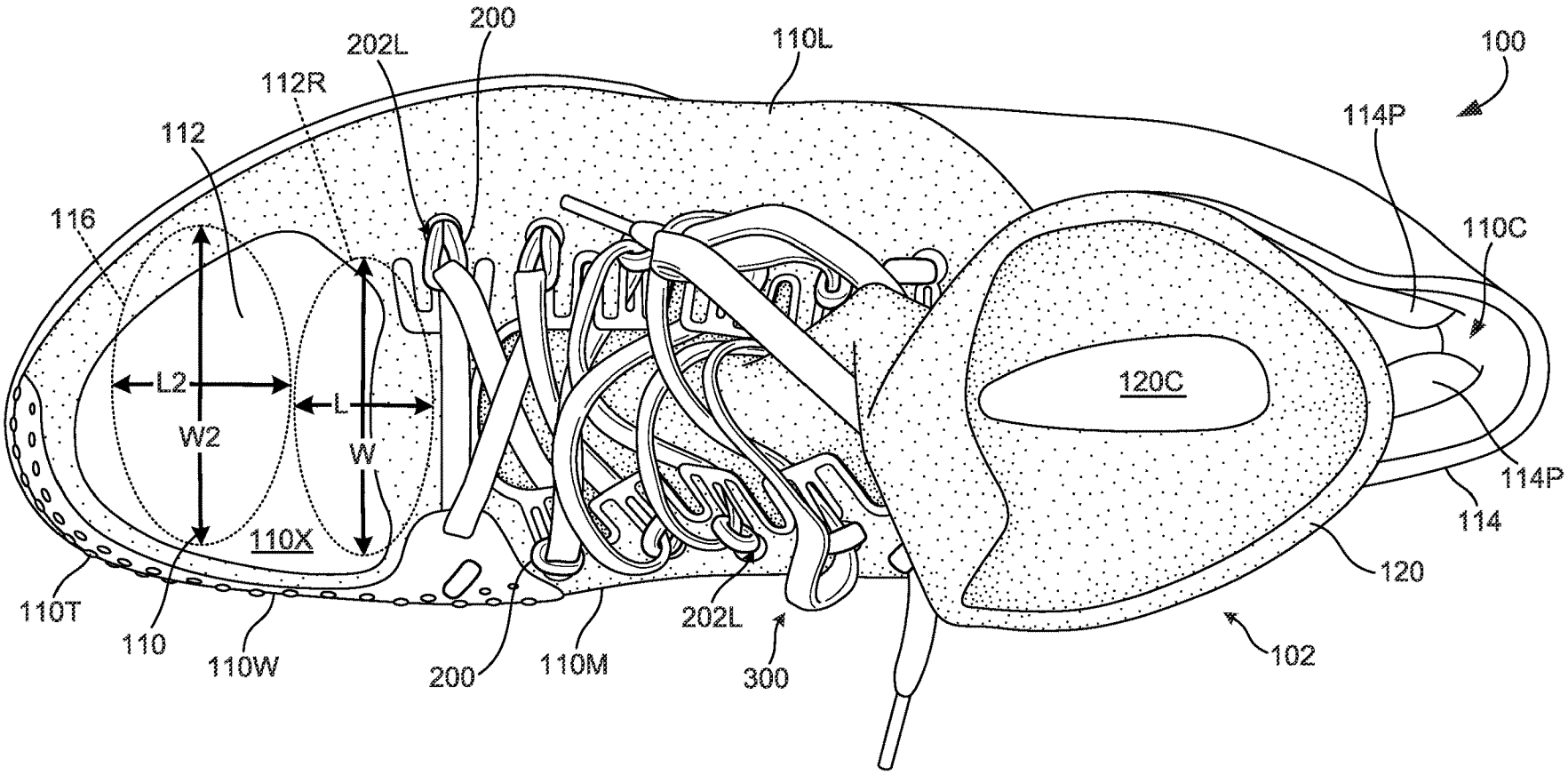
Figure 1D:
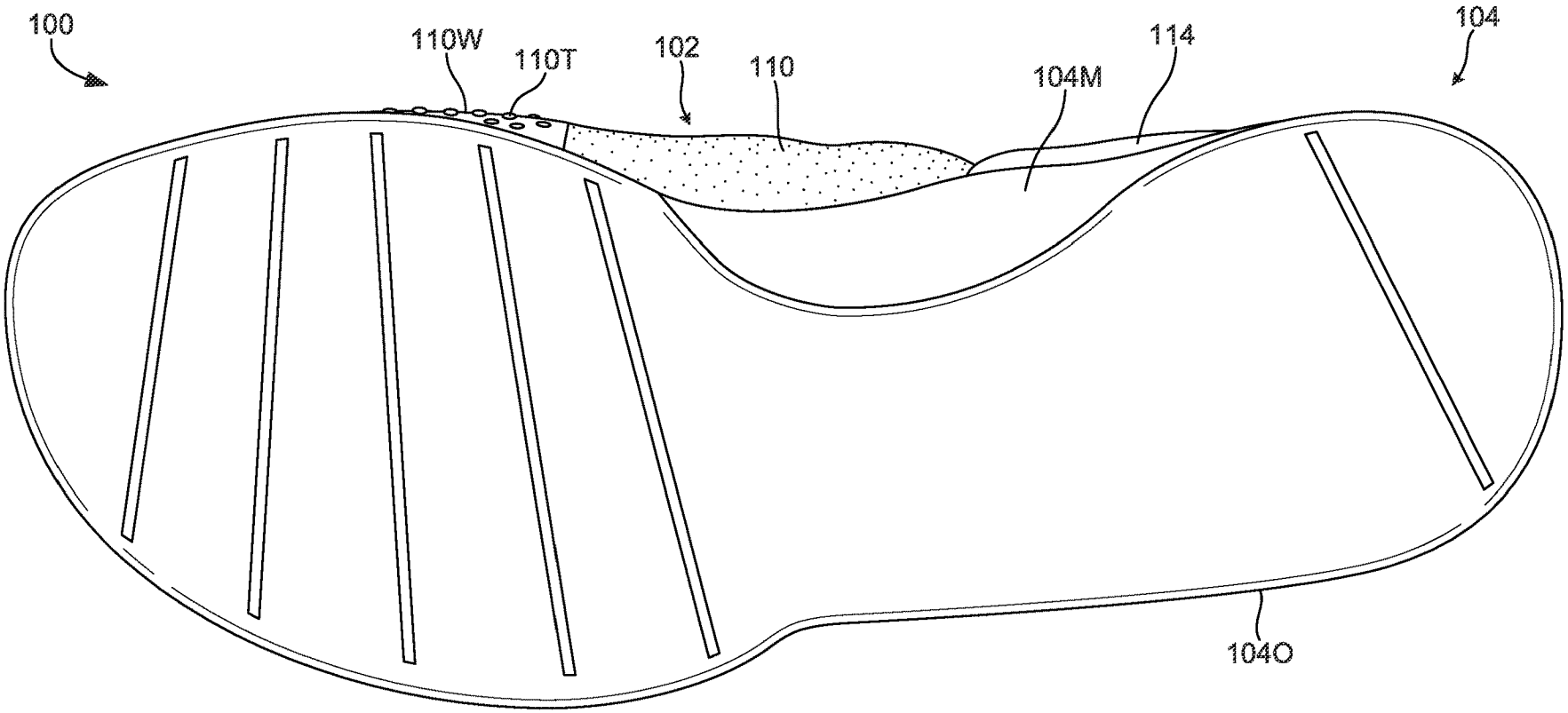

II. Detailed Description of Example Articles of Footwear and Other Components/Features According to this Invention FIGS. 1A-1D provide various views of an example article of footwear 100 in accordance with at least some aspects of this invention. FIG. 1A provides a medial side view of the article of footwear 100, FIG. 1B provides a lateral side view, FIG. 1C provides a top view, and FIG. 1D provides a bottom view. This example article of footwear 100 includes an upper 102 and a sole structure 104 engaged with the upper 102. While articles of footwear 100 in accordance with aspects of this invention may be designed for any desired type of end use, in this specifically illustrated example, the article of footwear 100 is designed for use in playing tennis.

The sole structure 104 of this illustrated example includes a midsole 104M and an outsole 104O, e.g., engaged with the midsole 104M. The midsole 104M absorbs energy and provides impact force attenuation and may be configured to support an entire plantar surface of a wearer's foot. The midsole 104M may be made from any desired materials, including materials conventionally known and used in the footwear arts, such as polyurethane foams, ethylvinylacetate foams, and the like. Additionally or alternatively, the midsole 104M may be made from one or more parts and may include other impact force attenuating structures, such as one or more of: one or more fluid-filled bladders, one or more mechanical shock absorbers, etc. The outsole 104O provides traction and wear resistance and may be made from one or more parts. The outsole 104O may be made from any desired materials, including materials conventionally known and used in the footwear arts, such as thermoplastic polyurethanes, rubbers, and the like. If desired, the outsole 104O may be omitted at least at some locations at the bottom of the footwear 100 structure and/or the midsole 104M may function as the outsole at least at some locations. Alternatively, if desired, the midsole 104M may be omitted at least at some locations of the footwear 100 structure and/or the outsole 104O may function as the midsole at least at some locations. The midsole 104M and/or the outsole 104O may include grooves, flex lines, or the like, e.g., to enhance flexibility and/or natural motion of the sole structure 104, to provide traction, etc.

The components and structure of the upper 102 according to this specifically illustrated example of the invention now will be described in more detail with additional reference to FIG. 2A (a cross sectional view of an example footwear structure 100). The upper 102 of this example includes two main components (each of which may be made from one or more parts), namely an upper shell 110 and a bootie component 120. The upper shell 110 of this example, which may be made from one or more parts, includes a plantar support surface 110S, a lateral sidewall 110L, and a medial sidewall 110M. Each of the lateral sidewall 110L and the medial sidewall 110M extends upward from an outer perimeter 110P of the plantar support surface 110S. In this manner, the upper shell 110 defines an interior chamber 110C into which the bootie component 120 is received.

The upper shell 110 of this example is made from multiple component parts. One main part is a textile and/or polymeric component 110X forming much of the lateral sidewall 110L, the medial sidewall 110M, and the top panel 112, e.g., over the instep and/or forefoot containing area of the upper 102. A heel support 114 is provided around the heel area of the upper shell 110, e.g., to provide additional support for the heel area of a wearer's foot. The heel support 114 may be made from a stiffer or less flexible material than the textile/polymeric component 110X, e.g., from a rubber or thermoplastic polyurethane material. The heel support 114 may constitute a heel counter structure, if desired. The interior heel area of the upper shell 110 may include foam and/or gel type pads or comfort-enhancing components 114P, e.g., that comfortably engage and/or conform in shape to the wearer's ankle (note also FIG. 4F). The medial side of the forward toe and forefoot area of this example upper shell 110 includes a wear resistant component 110W, which in this example may be made of a plastic material (e.g., a thermoplastic polyurethane, a rubber material, etc.). This wear resistant component 110W is useful in this example footwear 100 structure to provide additional protection for the "big toe" area of the upper 102, which can receive substantial wear when playing tennis (e.g., during serves, when changing direction, etc.). Additionally, if desired, the outer surface of the wear resistant component 110W may include traction elements 110T, e.g., made of rubber or other "gripping" material, to provide additional traction at appropriate times (e.g., during a serve, etc.). The traction elements 110T are provided as small round "dots" of traction enhancing material in this illustrated example.

As mentioned above, in this example upper 102 structure, a bootie component 120 is received in the interior chamber 110C defined (at least in part) by the upper shell 110. In this example, the bootie component 120 has a "sock-like" configuration, e.g., made from a knit material, that closely receives, engages, and conforms in shape to the wearer's foot. Optionally, the bootie component 120 may be made by a circular knitting procedure and/or from a material that provides a relatively tight and optionally compression fit against the wearer's foot. The bootie component 120 may include one or more of: cottons; polyesters; Lycra, elastane, and/or other elastic materials; etc. The bootie component 120 of this example defines an interior chamber 120C into which the wearer's foot is received.

Figure 1E:
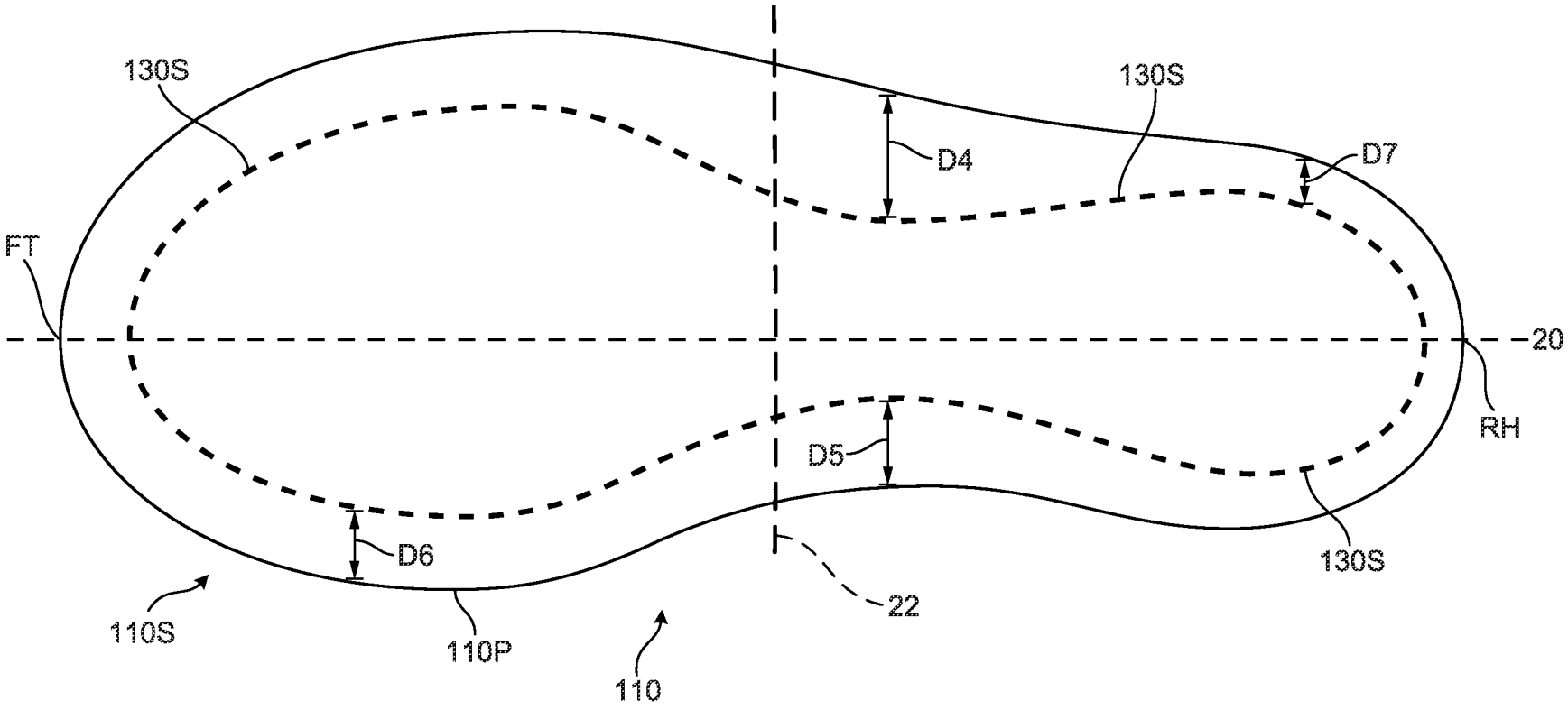
Figure 2A:
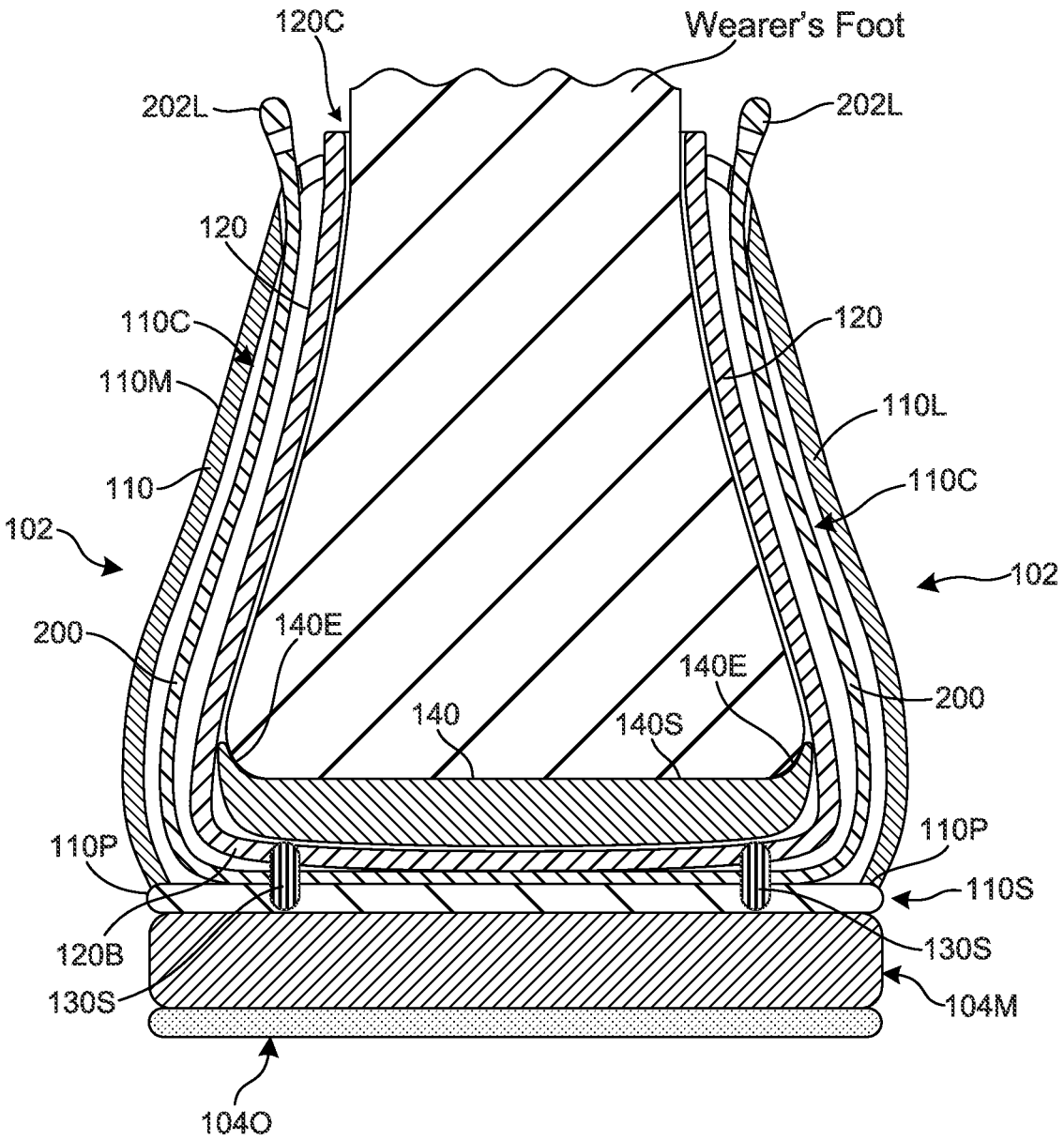
FIGS. 2A-2C provide various views showing an interior midsole component and its incorporation into articles of footwear in accordance with at least some examples of this invention.

FIGS. 1E and 2A illustrate example engagement of the bottom 120B of the bootie component 120 with the plantar support surface 110S of the upper shell 110. FIG. 1E illustrates a bottom surface of the upper shell 110 and FIG. 2A is a cross sectional view of the article of footwear 100. As shown in these figures, the bottom 120B of the bootie component 120 is fixed to the plantar support surface 110S of the upper shell 110 by a sewn seam 130S that in this example extends completely around the plantar support surface 110S as a complete loop (e.g., in an hourglass type shape). The sewn seam 130S is located inward from the outer perimeter 110P of the plantar support surface 110S. Connections of this general type are described, for example, in co-pending U.S. patent application Ser. No. 14/927,751; U.S. Pat. Nos. 9,609,908; 9,210,866; and U.S. Pat. No.

8,578,632, each of which is entirely incorporated herein by reference, and the connections shown in these patent documents can be used in conjunction with footwear structures 100 in accordance with at least some examples of this invention. As shown in FIG. 1E, the sewn seam 130S may be spaced inward from the outer perimeter edge 110P of the plantar support surface 110S by an inward spacing distance (e.g., distances D4 to D7 shown in FIG. 1E). This inward spacing distance may vary over the path of the sewn seam 130S, e.g., varying between 6 mm to 40 mm, and in some examples, between 6 mm and 25 mm. In at least some examples of this invention, the inward spacing distance (e.g., D4 to D7) may be at least 6 mm over at least 75% of an overall path of the seam 130S. As some additional or alternative potential features, the inward spacing distance (e.g., D4 to D7) may be: (a) at least 12 mm over at least 75% of an overall path of the seam 130S, (b) at least 6 mm over at least 80% of an overall path of the seam 130S, (c) at least 12 mm over at least 80% of an overall path of the seam 130S, (d) at least 6 mm over at least 90% of an overall path of the seam 130S, (e) at least 12 mm over at least 90% of an overall path of the seam 130S, (f) at least 6 mm over at least 95% of an overall path of the seam 130S, and/or (g) at least 12 mm over at least 95% of an overall path of the seam 130S.

Figure 1F:
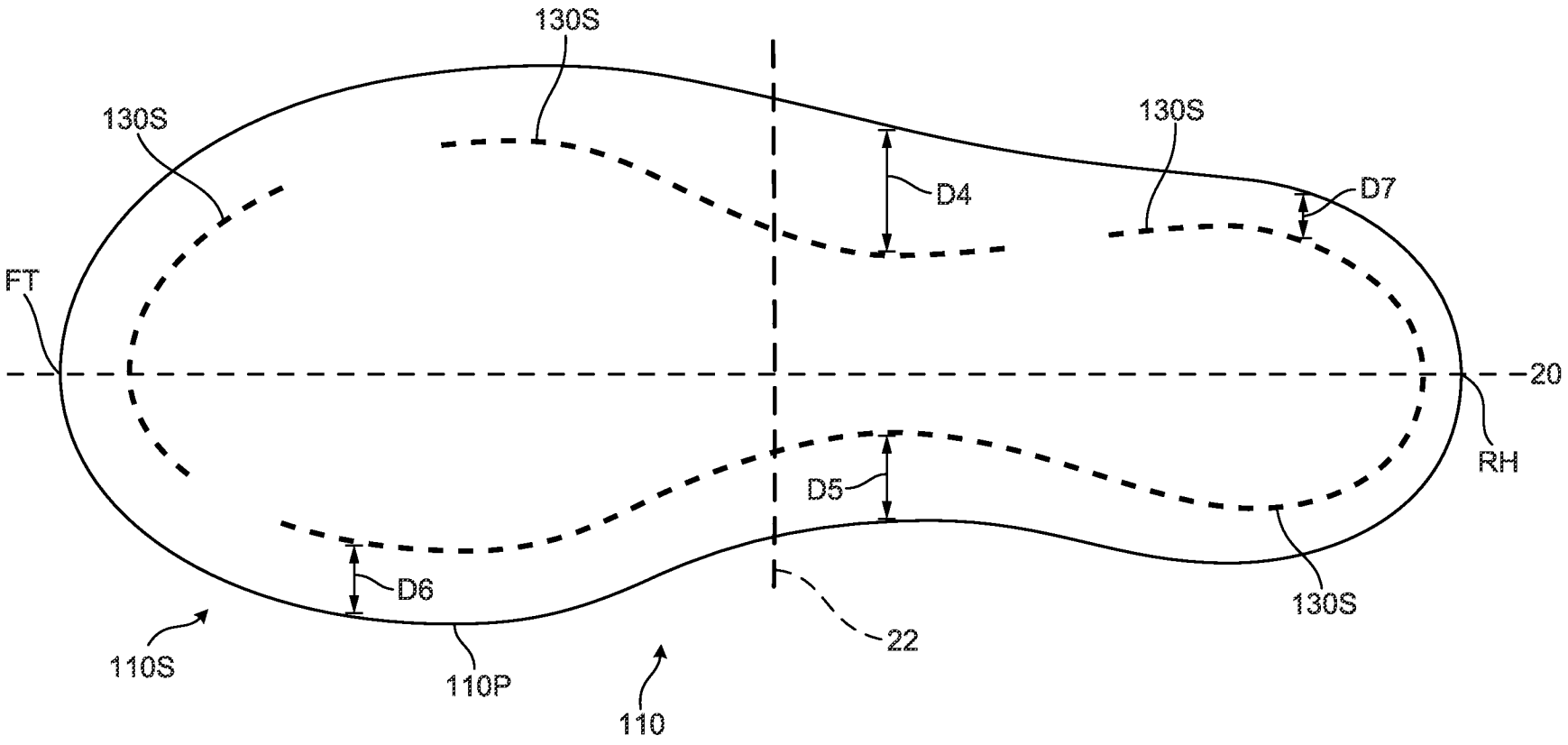

While FIG. 1E shows the sewn seam 130S extending completely around the plantar support surface 110S to form an inwardly spaced closed loop, other options are possible without departing from this invention. For example, if desired, one or more breaks may be provided in the sewn seam (see FIG. 1F, thereby producing seam segments). In this manner, support and coupling between the bootie component 120 and the upper shell 110 can be provided where needed or desired and a more "decoupled" structure can be provided at other locations. Any desired number of seam 130S segments and/or seam breaks around the plantar support surface 110S can be provided without departing from the invention. The seam segments of FIG. 1F can have any of the inward spacing features (e.g., D4 to D7) described above. Additionally or alternatively, if desired, rather than or in addition to the sewn seam 130S, the bottom of bootie component 120 may be fixed with the plantar support surface 110S of the upper shell 110 by adhesives or cements and/or by mechanical connectors without departing from this invention.

The bootie component 120 may be fixed with the upper shell 110 in other manners and/or in other areas as well. In at least some examples of this invention, the bootie component 120 may be fixedly engaged with the upper shell 110 at fixed connections that include (and optionally consist essentially of):

(a) one or more fixed bottom connections (e.g., shown by loop seam 130S and/or seam segments 130S in FIGS. 1E and 1F) between the bootie component 120 and the plantar support surface 110P of the upper shell 110, wherein the one or more fixed bottom connections is/are spaced inward (distances D4-D7), e.g., at least 6 mm, from the outer perimeter 110P of the plantar support surface 110S (the fixed bottom connection(s) may have any of the inward spacing features described above), and (b) one or more fixed top connections (e.g., using one or more of adhesives, stitching, mechanical fasteners, etc.) between the bootie component 120 and a top forefoot area (e.g., within top panel 112) of the upper shell 110, wherein each of the one or more fixed top connections is located within a fixed region 112R (see FIG. 1C) having: (i) a width dimension W (e.g., at a location of greatest width) of less than 5 cm in a medial side-to-lateral side direction (direction 22, see FIG. 1E, which is perpendicular to heel-to-toe direction 20 in FIG. 1E) of the upper 102 and/or the upper shell 110 and a length dimension L (e.g., at a location of greatest length) of less than 2 cm in a heel-to-toe direction (direction 20 from the rearmost heel location RH to a forwardmost toe location FT, see FIG. 1E) of the upper 102 and/or the upper shell 110 and/or (ii) a fixed area of less than 10 $cm^2$.

In at least some examples of this aspect of the invention, the top of the bootie component 120 will not be fixedly engaged with the top forefoot area of the upper shell 110 (e.g., not fixed to the inside surface of top panel 112) at a non-fixed region 116 located forward of the fixed region 112R. Optionally, this non-fixed region 116 may have: (i) a second length dimension L2 of at least 2 cm in the heel-to-toe direction of the upper 102 and/or upper shell 110 and/or (ii) a non-fixed area of at least 10 $cm^2$. Additionally or alternatively, the bootie component 120 need not be fixedly engaged with a medial side 110M of the upper shell 110 and/or the bootie component 120 need not be fixedly engaged with a lateral side 110L of the upper shell 110. The non-fixed region 116 may help allow the sock-like bootie component 120 conform to the wearer's foot and may help maintain a secure, "locked-down" feel of the upper 102.

The fixed top connection(s) in these aspects or examples of the invention may have any one or more of the following properties: (a) a width dimension W (e.g., at a location of greatest width) of less than 4 cm in a medial side-to-lateral side direction, (b) a width dimension W (e.g., at a location of greatest width) of less than 3 cm in a medial side-to-lateral side direction, (c) a width dimension W (e.g., at a location of greatest width) of less than 2.5 cm in a medial side-to-lateral side direction, (d) a length dimension L (e.g., at a location of greatest length) of less than 1.75 cm in a heel-to-toe direction, (e) a length dimension L (e.g., at a location of greatest length) of less than 1.5 cm in a heel-to-toe direction, (f) a length dimension L (e.g., at a location of greatest length) of less than 1 cm in a heel-to-toe direction, (g) a fixed area of fixed region 112R of less than 8 $cm^2$, (h) a fixed area of fixed region 112R of less than 6 $cm^2$, and/or (i) a fixed area of fixed region 112R of less than 5 $cm^2$.

Additionally or alternatively, when present, the non-fixed region 116 forward of the fixed region 112R in these aspects or examples of the invention may have any one or more of the following properties: (a) a width dimension W2 (e.g., at a location of greatest width) of at least 3 cm in a medial side-to-lateral side direction, (b) a width dimension W2 (e.g., at a location of greatest width) of at least 4 cm in a medial side-to-lateral side direction, (c) a width dimension W2 (e.g., at a location of greatest width) of at least 5 cm in a medial side-to-lateral side direction, (d) a length dimension L2 (e.g., at a location of greatest length) of at least 2.5 cm in a heel-to-toe direction, (e) a length dimension L2 (e.g., at a location of greatest length) of at least 3.5 cm in a heel-to-toe direction, (f) a length dimension L2 (e.g., at a location of greatest length) of at least 4 cm in a heel-to-toe direction, (g) a non-fixed area of non-fixed region 116 of at least 12 $cm^2$, (h) a non-fixed area of non-fixed region 116 of at least 15 $cm^2$, (i) a non-fixed area of non-fixed region 116 of at least 18 $cm^2$, and/or (j) a non-fixed area of non-fixed region 116 of at least 21 $cm^2$.

Figure 2B:
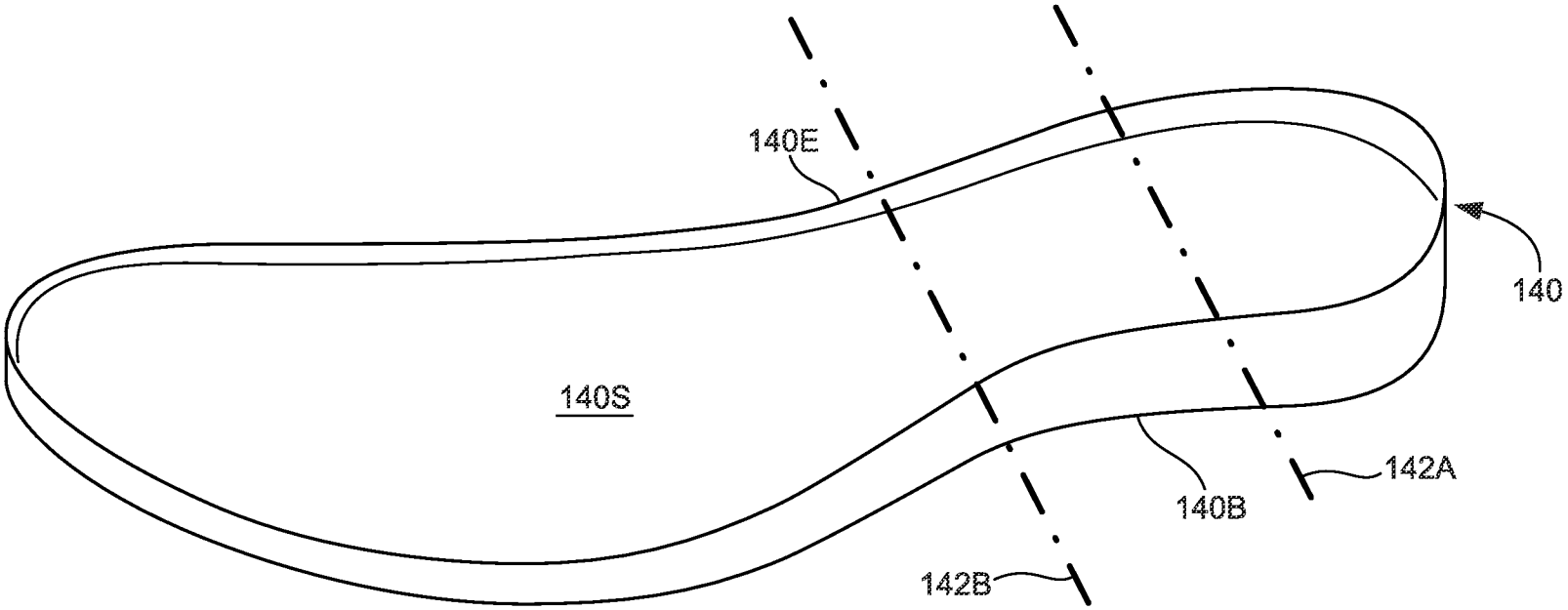
Figure 2C:
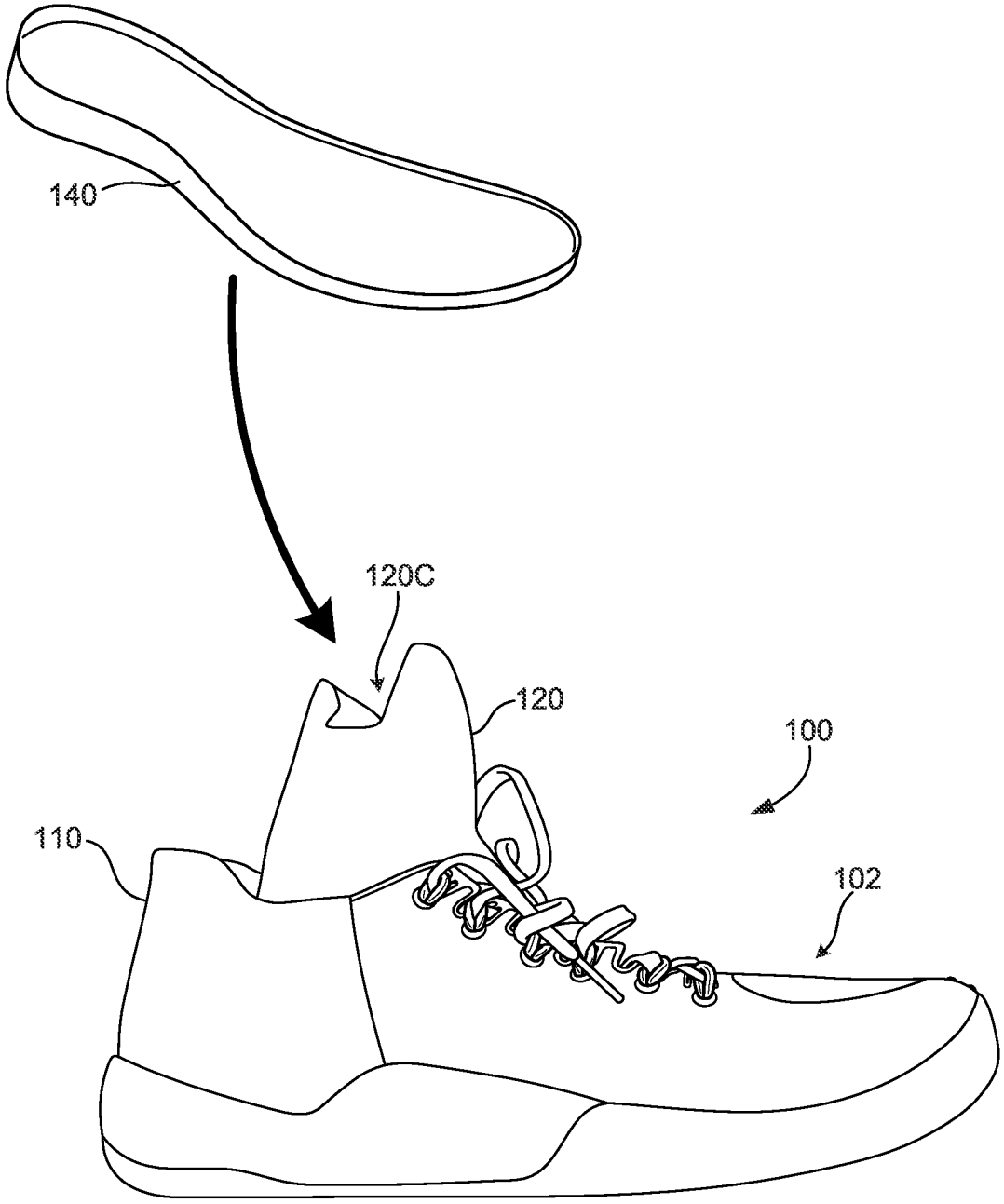
Figure 3A:
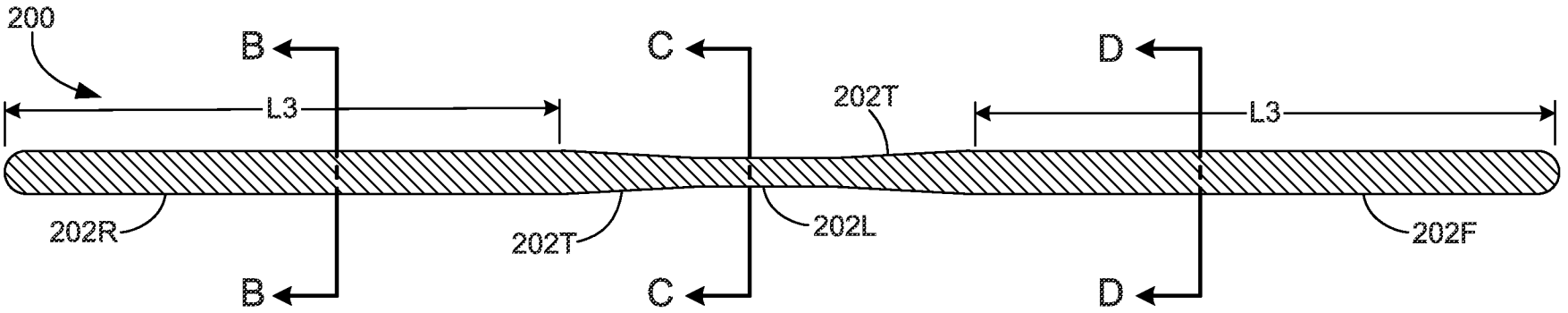
FIGS. 3A-3D provide various views of an example foot wrapping band that may be included in articles of footwear in accordance with at least some examples of this invention.
Figure 3C:
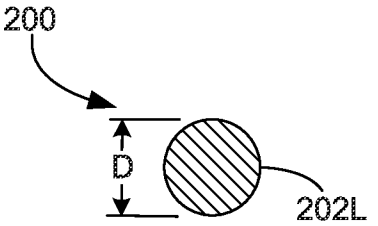
Figure 3D:
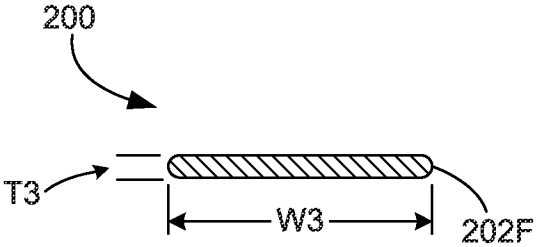
Figure 3B:
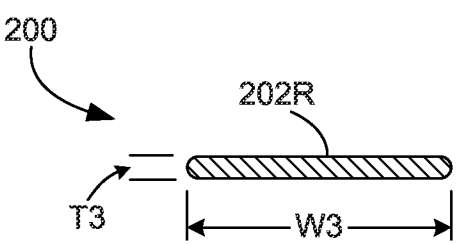

FIGS. 2A-2C show further features that may be included in uppers 102 (or foot-covering components) and/or articles of footwear 100 (or other foot-receiving devices) in accordance with at least some examples of this invention. As shown in these figures, an interior midsole 140 is provided within the foot-receiving chamber 120C of the bootie component 120. The top surface 140S of the interior midsole 140 may be contoured to correspond to the shape of a wearer's foot, and if desired, the outer edges 140E may curve upward somewhat, e.g., to help stably position the wearer's foot on the top surface 140S. The interior midsole 140 may be inserted into the foot-receiving chamber 120C of the bootie component 120, e.g., as shown in FIG. 2C, so that the interior midsole 140 will be in direct contact with and/or the closest footwear 100 component to a plantar surface of a wearer's foot. The interior midsole 140 may be made of a foam material, e.g., a lightweight foam material, made from polyurethane foam, ethylvinylacetate foam, and/or other foam materials. The interior midsole 140 may be thickest (e.g., the dimension from its top surface 140S to its bottom surface 140B) at a forward heel support area and/or a midfoot/arch support area of the midsole 140 (e.g., between lines 142A and 142B in FIG. 2B).

The interior midsole 140 of this example footwear 100 structure may be somewhat thicker than conventional footwear insoles and/or sockliners. As some more specific examples, the interior midsole 140 may have: (a) a thickness of at least 6 mm through at least 50% of its top surface 140S (measuring directly from the top surface 140S to the bottom surface 140B), (b) a thickness of at least 6 mm through at least 70% of its top surface 140S, (c) a thickness of at least 6 mm through at least 80% of its top surface 140S, (d) a thickness of at least 6 mm through at least 90% of its top surface 140S, (e) a thickness of at least 9 mm through at least 50% of its top surface 140S, (f) a thickness of at least 9 mm through at least 70% of its top surface 140S, and/or (g) a thickness of at least 11 mm through at least 50% of its top surface 140S. The foam material of the interior midsole 140, its thickness, and its location directly beneath the wearer's foot enhance comfort of the overall footwear 100 structure of this specific example. In addition, the raised outer edges 140E of the interior midsole 140 can help moderate the feel of the foot wrapping band(s) 200, which will be described in more detail below. The location of this example interior midsole 140 (i.e., between the wearer's foot and the location where the foot wrapping bands 200 are connected to the upper shell 110) can help improve comfort and moderate wearer feel/awareness of the foot wrapping bands 200, especially when a lace 300 pulls the foot wrapping bands 200 tight (as will be described in more detail below).

While the interior midsole 140 of this illustrated example is removable from the interior chamber 120C of the bootie component 120, other options are possible. For example, if desired, the interior midsole 140 could be fixed within the interior chamber 120C, e.g., by adhesives, mechanical connectors (e.g., hook-and-loop fasteners), sewn seams, etc. Additionally or alternatively, if desired, a midsole component (e.g., foam, fluid-filled bladder(s), etc.) may be provided between the bootie component 120 and the upper shell 110, e.g., in place of and/or in addition to an interior midsole 140 in the interior chamber 120C of the bootie component 120.

FIGS. 3A-4G illustrate various potential features of foot wrapping bands 200 that may be included in articles of footwear 100 in accordance with at least some examples of this invention. As shown in these figures, each side (i.e., the lateral side and the medial side) of the article of footwear 100 includes at least one foot wrapping band 200, and optionally a plurality of foot wrapping bands 200 on each side. Note also FIGS. 1A-1C and 2A. The wrapping band(s) 200 of these illustrated examples include a lace engaging element 202L (e.g., in a generally central area of the band 200), (b) a rearwardly extending band segment 202R extending from the lace engaging element 202L (optionally extending between the upper shell 110 and the bootie component 120), and (c) a forwardly extending band segment 202F extending from the lace engaging element 202L (optionally between the upper shell 110 and the bootie component 120). Optionally, the rearwardly extending band segment 202R may be engaged with the plantar support surface 110S of the upper shell 110 at a fixed bottom connection spaced inward from the outer perimeter 110P of the plantar support surface 110S and/or the forwardly extending band segment 202F extends forward of the rearwardly extending band segment 202R and may be engaged with the plantar support surface 110S at a fixed bottom connection spaced inward from the outer perimeter 110P of the plantar support surface 110S. If desired, the band segment(s) 202R and/or 202F may be engaged with the plantar support surface 110S at location(s) spaced inward from the outer perimeter 110P of the plantar support surface 110S using the same fixed connection as used to engage the plantar support surface 110S with the bootie component 120 (e.g., sewn seam 130S, adhesives or cements, mechanical fasteners, etc.). As shown in FIGS. 1A-1C, the lace engaging element 202L extends through the openings in the upper components 110M, 110L and form a loop through which the lace 300 extends.

FIGS. 3A-3D show additional potential features of foot wrapping bands 200 that may be included in articles of footwear 100 in accordance with at least some examples of this invention. As shown in these figures, the foot wrapping bands 200 change in cross sectional shape from a relatively thin and flat shape at the rearwardly extending segment 202R and the forwardly extending segment 202F to relatively circular shape at the lace engaging element 202L. Transitional areas 202T include an area intermediate in cross sectional shape between: (a) the relatively thin and flat cross sectional shape of rearwardly extending segment 202R and forwardly extending segment 202F and (b) the relatively circular cross sectional shape at the lace engaging element 202L. One or more of the foot wrapping bands 200 may be formed as a unitary, one-piece construction, if desired. The relatively thin and flat shape of the forwardly extending segment 202F and the rearwardly extending segment 202R can help provide a more comfortable fit or feel, e.g., when a lace (e.g., 300) pulls the foot wrapping band(s) 200 tight, in some instances into contact with the wearer's foot. The thin and flat shape can help spread out the applied force and thus moderate the feel of the foot wrapping band(s) 200 against the wearer's foot.

As some more specific examples, at least one of the rearwardly extending band segments 202R and/or the forwardly extending medial band segments 202F has a longitudinal length L3, a width W3, and a thickness T3, wherein:

$T3 \geq 1$ mm, $W3 \geq 3T3$, and $L3 \geq 10$ W3.

In some examples, T3 will be greater than or equal to 2 mm and/or greater than or equal to 3 mm. As other options or alternatives, T3 may be less than 5 mm or even less than 4 mm and/or W3 may be at least 3 mm, at least 5 mm, at least 8 mm, or even at least 10 mm. As other additional or alternative example features, in the lace engaging element 202L area of the foot wrapping band(s) 200, the lace engaging element 202L may have a diameter D of less than 15 mm, and in some examples, a diameter of less than 12 mm, or even less than 10 mm. The transitional area(s) 202T may have a length dimension of less than 25 mm, and in some examples, less than 20 mm, less than 15 mm, or even less than 10 mm.

In at least some examples of this aspect of the invention, the rearwardly extending segment 202R and/or the forwardly extending segment 202F may be shaped somewhat like a "flat" shoelace, and optionally made of the same material(s) as conventional shoelaces, e.g., for athletic footwear. As some more specific examples, the foot wrapping bands 200 (or at least the rearwardly extending segment 202R and/or the forwardly extending segment 202F thereof) may be made from leather, cotton, jute, hemp, other materials used in the manufacture of rope, synthetic fibers (e.g., polyesters), etc. In at least some examples of this invention, the foot wrapping bands 200 (or at least the rearwardly extending segment 202R and/or the forwardly extending segment 202F thereof) may be made from relatively "unstretchable" materials (e.g., materials that stretch less than 10% of their axial length under a tensile force of 50 lbs).

Figure 4A:
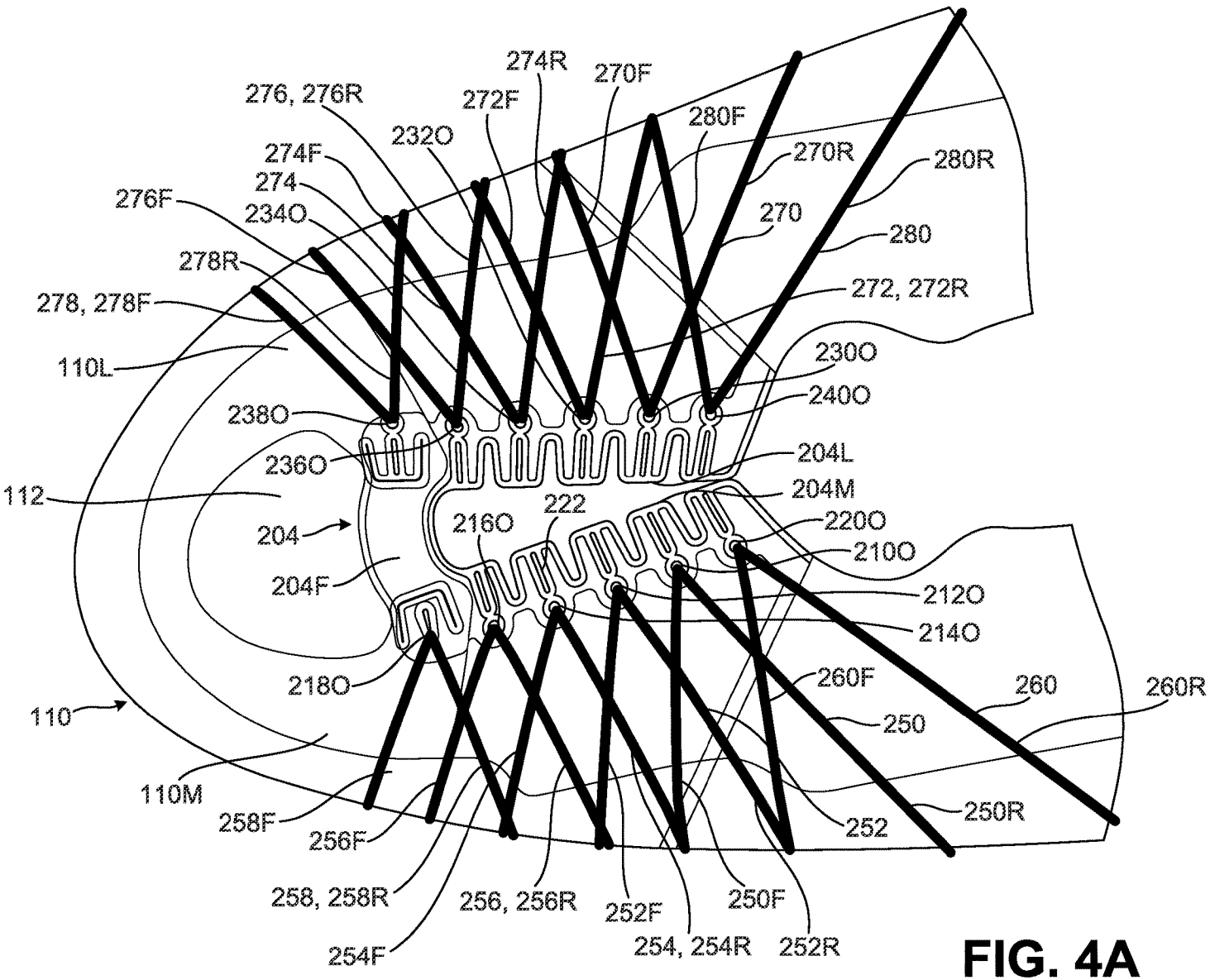
FIGS. 4A-4G provide various views illustrating engagement and orientation of a footwear upper shell, a bootie component, and foot wrapping bands in accordance with some examples of this invention.
Figure 4B:
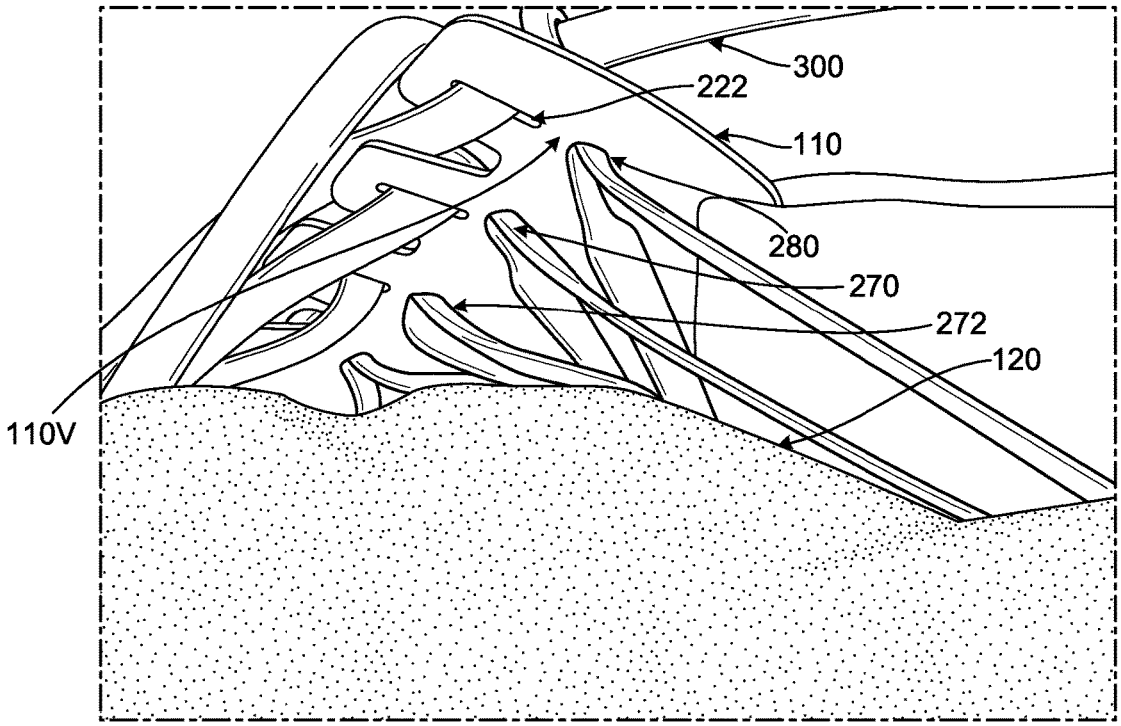
Figure 4C:
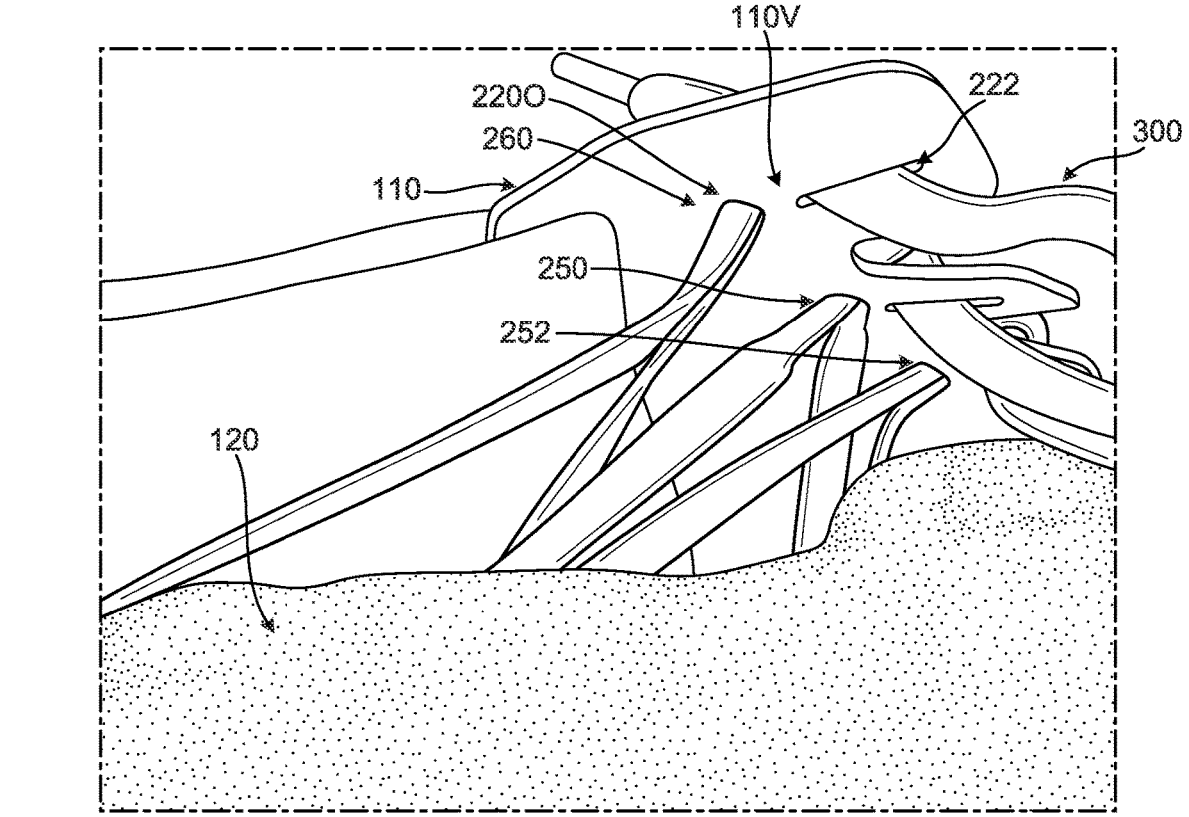
Figure 4D:
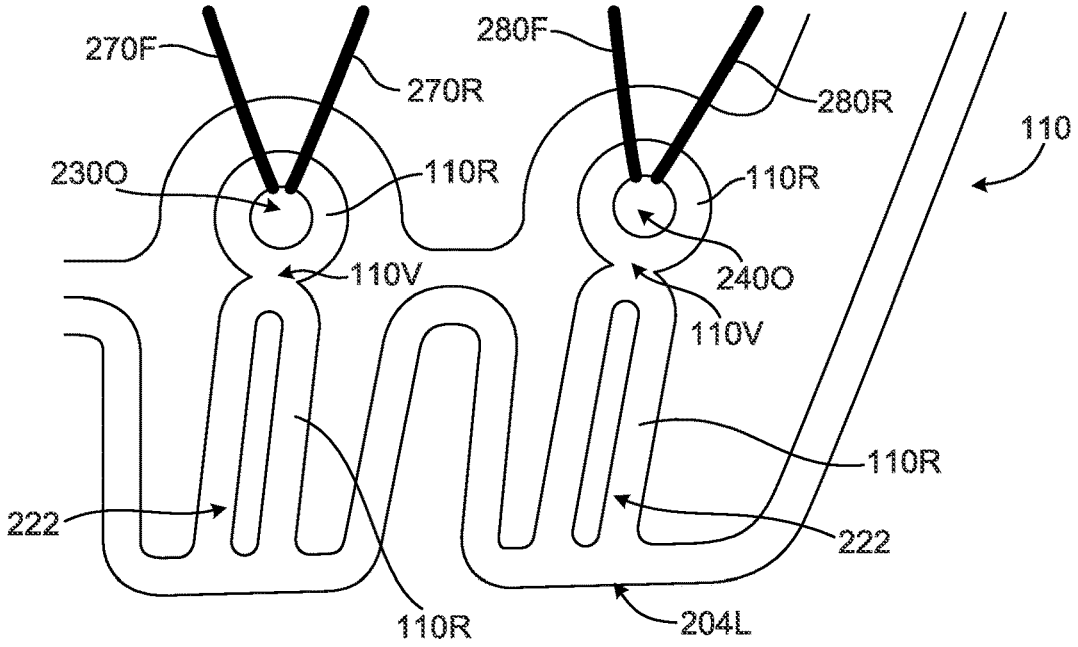
Figure 4E:
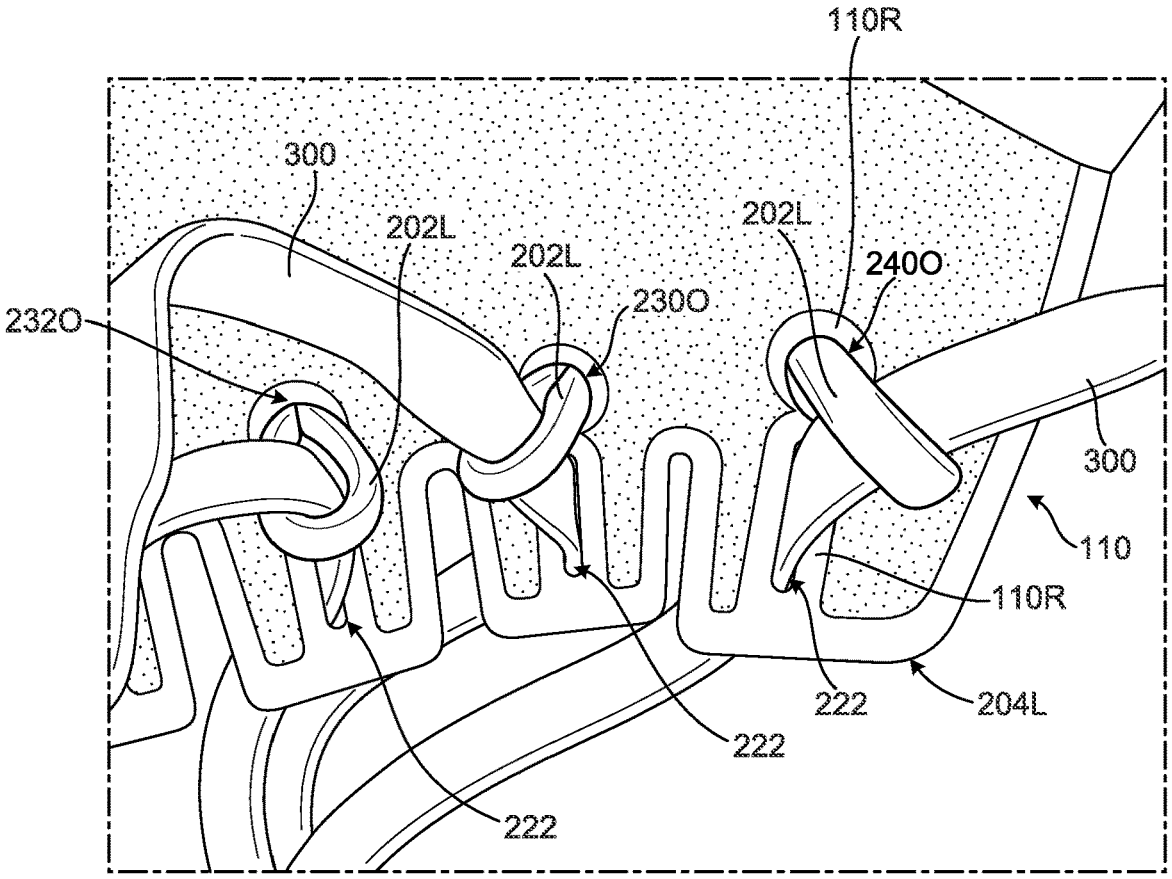
Figure 4F:
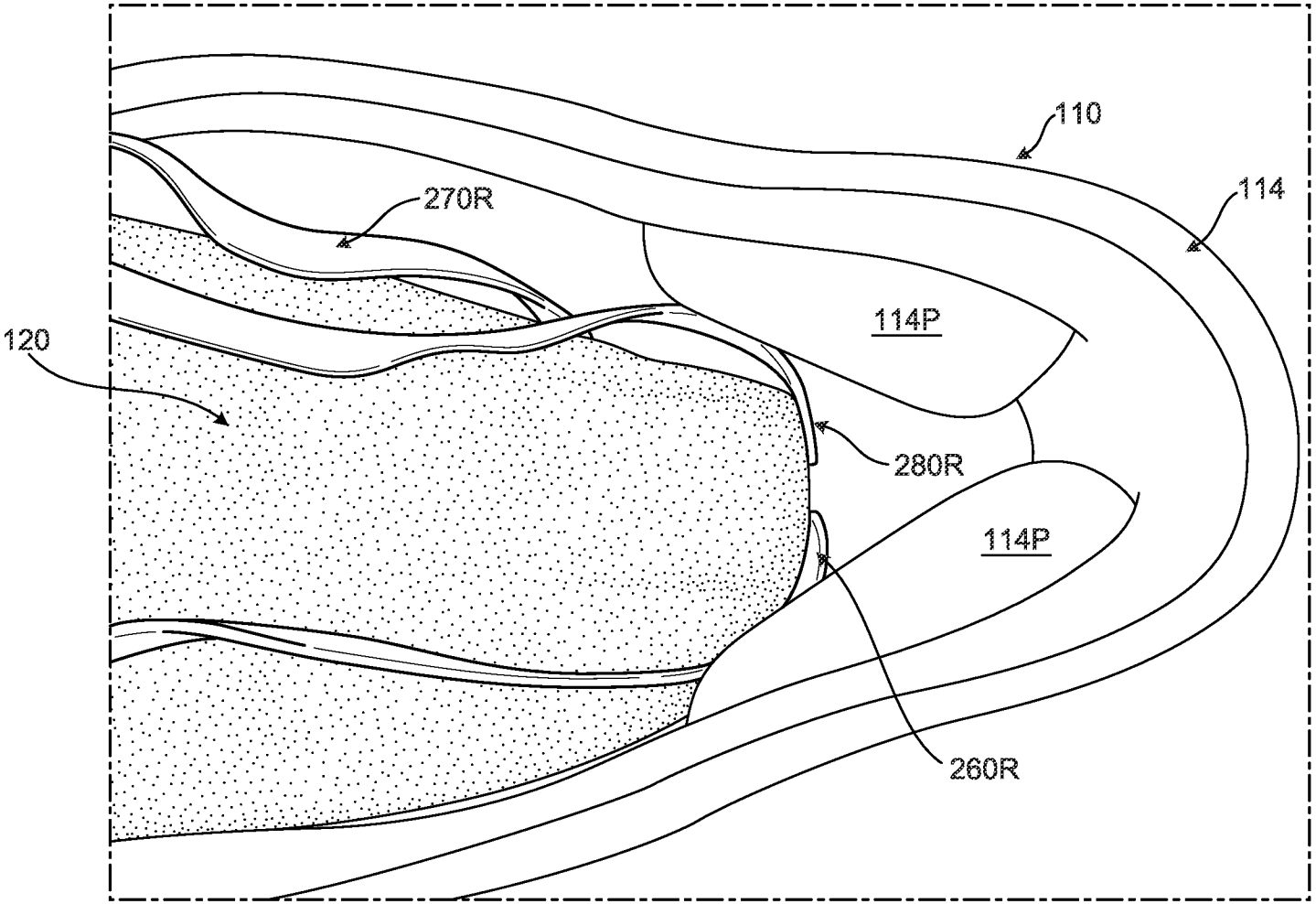

FIGS. 4A-4G, along with FIGS. 1A-1C and 2A, illustrate one manner in which foot wrapping band(s) 200 may be engaged with a footwear upper 102 and/or a lace 300 in accordance with at least some examples of this invention. With particular reference to FIG. 4A, the upper shell 110 is illustrated with a set of foot wrapping bands 200 laid out on its interior surface. As shown in FIG. 4A, this example upper 102 (e.g., upper shell 110) includes a medial sidewall 110M and a lateral sidewall 110L, and a top panel 112 is engaged or integrally formed with at least one of the medial sidewall 110M and/or the lateral sidewall 110L. The medial sidewall 110M, the lateral sidewall 110L, and the top panel 112 define a lace engaging region 204 of the upper 102 and/or the upper shell 110, and this lace engaging region 204 has a medial side edge 204M, a lateral side edge 204L, and a forward edge 204F. This example upper 102 also may include a bottom plantar support surface 110S component (not shown in FIG. 4A) and/or a bootie component 120, e.g., of the types described above and/or having any of the structural features, connections, and/or other characteristics described above. The outer edge of the upper shell 110 shown in FIG. 4A may be engaged with a separate bottom plantar support surface 110S component (such as a footwear strobel member), e.g., as shown in FIG. 2A.

As further shown in FIG. 4A, the medial side edge 204M of the lace engaging region 204 of this illustrated example upper shell 110 includes one or more of a first medial side opening 210O, a second medial side opening 212O located forward of the first medial side opening 210O, a third medial side opening 214O located forward of the second medial side opening 212O, a fourth medial side opening 216O located forward of the third medial side opening 214O, a fifth medial side opening 218O located forward of the fourth medial side opening 216O, and a rearmost medial side opening 220O located rearward of the first medial side opening 210O. Similarly, the lateral side edge 204L of the lace engaging region 204 of this illustrated example upper shell 110 includes one or more of a first lateral side opening 230O, a second lateral side opening 232O located forward of the first lateral side opening 230O, a third lateral side opening 234O located forward of the second lateral side opening 232O, a fourth lateral side opening 236O located forward of the third lateral side opening 234O, a fifth lateral side opening 238O located forward of the fourth lateral side opening 236O, and a rearmost lateral side opening 240O located rearward of the first lateral side opening 230O. Note also FIGS. 4D and 4E. The upper shell 110 of this illustrated example further includes lace engaging slits or slots 222 located adjacent the side openings 210O-220O and 230O-240O. In this illustrated example, each side opening 210O-220O and 230O-240O has a lace engaging slit or slot 222 associated with it, but the side opening 210O-220O and 230O-240O is not continuous with its associated lace engaging slit or slot 222. In other words, in this illustrated example, a continuous portion 110V of the upper shell 110 extends between each side opening 210O-220O and 230O-240O and its associated lace engaging slit or slot 222.

The layout of foot wrapping bands of this example now will be described in more detail. Note, for example, FIGS. 2A and 4A. A first medial side foot wrapping band 250 includes: (a) a first medial lace engaging element (not shown in the view of FIG. 4A but akin to element 202L) extending through the first medial side opening 210O, (b) a first medial band segment 250R extending from the first medial lace engaging element and between the medial sidewall 110M and the bootie component 120, wherein the first medial band segment 250R is engaged with the bottom plantar support surface 110S of the upper shell 110 at a fixed bottom connection (e.g., sewn seam 130S) that is spaced inward from the outer perimeter edge 110P of the bottom plantar support surface 110S, and (c) a second medial band segment 250F extending from the first medial lace engaging element and between the medial sidewall 110M and the bootie component 120, wherein the second medial band segment 250F extends forward of the first medial band segment 250R and is engaged with the bottom plantar support surface 110S of the upper shell 110 at a fixed bottom connection (e.g., sewn seam 130S) that is spaced inward from the outer perimeter edge 110P of the plantar support surface 110S. In this manner, first medial band segment 250R and second medial band segment 250F form a "V" shaped structure that wraps around a medial side of the wearer's foot and may tighten against the foot when a lace 300 is tightened. The vertex of this "V" shaped structure forms the lace engaging element.

This example upper 102 structure further includes a second medial side foot wrapping band 252 that includes: (a) a second medial lace engaging element (not shown in the view of FIG. 4A but akin to element 202L) extending through the second medial side opening 212O, (b) a third medial band segment 252R extending from the second medial lace engaging element and between the medial sidewall 110M and the bootie component 120, wherein the third medial band segment 252R is engaged with the bottom plantar support surface 110S of the upper shell 110 at a fixed bottom connection (e.g., sewn seam 130S) that is spaced inward from the outer perimeter edge 110P of the bottom plantar support surface 110S, and (c) a fourth medial band segment 252F extending from the second medial lace engaging element and between the medial sidewall 110M and the bootie component 120, wherein the fourth medial band segment 252F extends forward of the third medial band segment 252R and is engaged with the bottom plantar support surface 110S of the upper shell 110 at a fixed bottom connection (e.g., sewn seam 130S) spaced inward from the outer perimeter edge 110P of the bottom plantar support surface 110S. In this manner, third medial band segment 252R and fourth medial band segment 252F form a "V" shaped structure (with the lace engaging element at the "V's" vertex) that wraps around a medial side of the wearer's foot and may tighten against the foot when a lace 300 is tightened. If desired, as shown in FIG. 4A, the medial side foot wrapping bands 250 and 252 may be arranged such that the third medial band segment 252R crosses the second medial band segment 250F along the medial sidewall 110M of the upper shell 110 (and along the medial side of a wearer's foot).

A third medial side foot wrapping band 254 is provided in this illustrated example structure that includes: (a) a third medial lace engaging element (not shown in the view of FIG. 4A but akin to element 202L) extending through the third medial side opening 214O, (b) a fifth medial band segment 254R extending from the third medial lace engaging element and between the medial sidewall 110M and the bootie component 120, wherein the fifth medial band segment 254R is engaged with the bottom plantar support surface 110S of the upper shell 110 at a fixed bottom connection (e.g., sewn seam 130S) that is spaced inward from the outer perimeter edge 110P of the bottom plantar support surface 110S, and (c) a sixth medial band segment 254F extending from the third medial lace engaging element and between the medial sidewall 110M and the bootie component 120, wherein the sixth medial band segment 254F extends forward of the fifth medial band segment 254R and is engaged with the bottom plantar support surface 110S of the upper shell 110 at a fixed bottom connection (e.g., sewn seam 130S) spaced inward from the outer perimeter edge 110P of the bottom plantar support surface 110S. In this manner, fifth medial band segment 254R and sixth medial band segment 254F form a "V" shaped structure (with the lace engaging element at the "V' s" vertex) that wraps around a medial side of the wearer's foot and may tighten against the foot when a lace 300 is tightened. If desired, as shown in FIG. 4A, the medial side foot wrapping bands 252 and 254 may be arranged such that the fifth medial band segment 254R crosses the fourth medial band segment 252F along the medial sidewall 110M of the upper shell 110 (and along the medial side of a wearer's foot).

A fourth medial side foot wrapping band 256 provided in this illustrated example upper 102 structure includes: (a) a fourth medial lace engaging element (not shown in the view of FIG. 4A but akin to element 202L) extending through the fourth medial side opening 216O, (b) a seventh medial band segment 256R extending from the fourth medial lace engaging element and between the medial sidewall 110M and the bootie component 120, wherein the seventh medial band segment 256R is engaged with the bottom plantar support surface 110S of the upper shell 110 at a fixed bottom connection (e.g., sewn seam 130S) that is spaced inward from the outer perimeter edge 110P of the bottom plantar support surface 110S, and (c) an eighth medial band segment 256F extending from the fourth medial lace engaging element and between the medial sidewall 110M and the bootie component 120, wherein the eighth medial band segment 256F extends forward of the seventh medial band segment 256R and is engaged with the bottom plantar support surface 110S of the upper shell 110 at a fixed bottom connection (e.g., sewn seam 130S) spaced inward from the outer perimeter edge 110P of the bottom plantar support surface 110S. In this manner, seventh medial band segment 256R and eighth medial band segment 256F form a "V" shaped structure (with the lace engaging element at the "V' s" vertex) that wraps around a medial side of the wearer's foot and may tighten against the foot when a lace 300 is tightened. If desired, as shown in FIG. 4A, the medial side foot wrapping bands 254 and 256 may be arranged such that the seventh medial band segment 256R crosses the sixth medial band segment 254F along the medial sidewall 110M of the upper shell 110 (and along the medial side of a wearer's foot).

This example upper 102 structure further includes a fifth medial side foot wrapping band 258 having: (a) a fifth medial lace engaging element (not shown in the view of FIG. 4A but akin to element 202L) extending through the fifth medial side opening 218O, (b) a ninth medial band segment 258R extending from the fifth medial lace engaging element and between the medial sidewall 110M and the bootie component 120, wherein the ninth medial band segment 258R is engaged with the bottom plantar support surface 110S of the upper shell 110 at a fixed bottom connection (e.g., sewn seam 130S) that is spaced inward from the outer perimeter edge 110P of the bottom plantar support surface 110S, and (c) a tenth medial band segment 258F extending from the fifth medial lace engaging element and between the medial sidewall 110M and the bootie component 120, wherein the tenth medial band segment 258F extends forward of the ninth medial band segment 258R and is engaged with the bottom plantar support surface 110S of the upper shell 110 at a fixed bottom connection (e.g., sewn seam 130S) spaced inward from the outer perimeter edge 110P of the bottom plantar support surface 110S. In this manner, ninth medial band segment 258R and tenth medial band segment 258F form a "V" shaped structure (with the lace engaging element at the "V's" vertex) that wraps around a medial side of the wearer's foot and may tighten against the foot when a lace 300 is tightened. If desired, as shown in FIG. 4A, the medial side foot wrapping bands 256 and 258 may be arranged such that the ninth medial band segment 258R crosses the eighth medial band segment 256F along the medial sidewall 110M of the upper shell 110 (and along the medial side of a wearer's foot).

The medial side of the upper 102 of this specifically illustrated example further includes a rearmost medial side foot wrapping band 260 that includes: (a) a medial lace engaging element (not shown in the view of FIG. 4A but akin to element 202L) extending through the rearmost medial side opening 220O; (b) a rearward extending medial band segment 260R extending from the medial lace engaging element and between the medial sidewall 110M and the bootie component 120, wherein the rearward extending medial band segment 260R is engaged with (i) a rear heel area of the bootie component 120 (see also FIG. 4F) and/or (ii) the bottom plantar support surface 110S of the upper shell 110 at a fixed bottom connection (e.g., sewn seam 130S) that is spaced inward from the outer perimeter edge 110P of the bottom plantar support surface 110S; and (c) another medial band segment 260F extending from the medial lace engaging element and between the medial sidewall 110M and the bootie component 120, wherein this other medial band segment 260F extends forward of the rearward extending medial band segment 260R and is engaged with the bottom plantar support surface 110S of the upper shell 110 at a fixed bottom connection (e.g., sewn seam 130S) spaced inward from the outer perimeter edge 110P of the bottom plantar support surface 110S and may tighten against the foot when a lace 300 is tightened. In this manner, the medial band segments 260R and 260F form a "V" shaped structure (with the lace engaging element at the "V' s" vertex) that wraps around a medial side of the wearer's foot. If desired, as shown in FIG. 4A, the first medial side foot wrapping band 250 and the rearmost foot wrapping band 260 may be arranged such that the first medial band segment 250R crosses the medial band segment 260F along the medial sidewall 110M of the upper shell 110 (and along the medial side of a wearer's foot).

The layout of the foot wrapping bands on the lateral side of this example upper 102 now will be described in more detail. A first lateral side foot wrapping band 270 includes: (a) a first lateral lace engaging element (not shown in the view of FIG. 4A but akin to element 202L) extending through the first lateral side opening 230O, (b) a first lateral band segment 270R extending from the first lateral lace engaging element and between the lateral sidewall 110L and the bootie component 120, wherein the first lateral band segment 270R is engaged with the bottom plantar support surface 110S of the upper shell 110 at a fixed bottom connection (e.g., sewn seam 130S) that is spaced inward from the outer perimeter edge 110P of the bottom plantar support surface 110S, and (c) a second lateral band segment 270F extending from the first lateral lace engaging element and between the lateral sidewall 110L and the bootie component 120, wherein the second lateral band segment 270F extends forward of the first lateral band segment 270R and is engaged with the bottom plantar support surface 110S of the upper shell 110 at a fixed bottom connection (e.g., sewn seam 130S) that is spaced inward from the outer perimeter edge 110P of the plantar support surface 110S. In this manner, first lateral band segment 270R and second lateral band segment 270F form a "V" shaped structure that wraps around a lateral side of the wearer's foot and may tighten against the foot when a lace 300 is tightened. The lace engaging element is provided at the vertex of this "V" shaped structure.

This example upper 102 structure further includes a second lateral side foot wrapping band 272 that includes: (a) a second lateral lace engaging element (not shown in the view of FIG. 4A but akin to element 202L) extending through the second lateral side opening 232O, (b) a third lateral band segment 272R extending from the second lateral lace engaging element and between the lateral sidewall 110L and the bootie component 120, wherein the third lateral band segment 272R is engaged with the bottom plantar support surface 110S of the upper shell 110 at a fixed bottom connection (e.g., sewn seam 130S) that is spaced inward from the outer perimeter edge 110P of the bottom plantar support surface 110S, and (c) a fourth lateral band segment 272F extending from the second lateral lace engaging element and between the lateral sidewall 110L and the bootie component 120, wherein the fourth lateral band segment 272F extends forward of the third lateral band segment 272R and is engaged with the bottom plantar support surface 110S of the upper shell 110 at a fixed bottom connection (e.g., sewn seam 130S) spaced inward from the outer perimeter edge 110P of the bottom plantar support surface 110S. In this manner, third lateral band segment 272R and fourth lateral band segment 272F form a "V" shaped structure (with the lace engaging element at the "V's" vertex) that wraps around a lateral side of the wearer's foot and may tighten against the foot when a lace 300 is tightened. If desired, as shown in FIG. 4A, the lateral side foot wrapping bands 270 and 272 may be arranged such that the third lateral band segment 272R crosses the second lateral band segment 270F along the lateral sidewall 110L of the upper shell 110 (and along the lateral side of a wearer's foot).

A third lateral side foot wrapping band 274 is provided in this illustrated example structure that includes: (a) a third lateral lace engaging element (not shown in the view of FIG. 4A but akin to element 202L) extending through the third lateral side opening 234O, (b) a fifth lateral band segment 274R extending from the third lateral lace engaging element and between the lateral sidewall 110L and the bootie component 120, wherein the fifth lateral band segment 274R is engaged with the bottom plantar support surface 110S of the upper shell 110 at a fixed bottom connection (e.g., sewn seam 130S) that is spaced inward from the outer perimeter edge 110P of the bottom plantar support surface 110S, and (c) a sixth lateral band segment 274F extending from the third lateral lace engaging element and between the lateral sidewall 110L and the bootie component 120, wherein the sixth lateral band segment 274F extends forward of the fifth lateral band segment 274R and is engaged with the bottom plantar support surface 110S of the upper shell 110 at a fixed bottom connection (e.g., sewn seam 130S) spaced inward from the outer perimeter edge 110P of the bottom plantar support surface 110S. In this manner, fifth lateral band segment 274R and sixth lateral band segment 274F form a "V" shaped structure (with the lace engaging element at the "V' s" vertex) that wraps around a lateral side of the wearer's foot and may tighten against the foot when a lace 300 is tightened. If desired, as shown in FIG. 4A, the lateral side foot wrapping bands 272 and 274 may be arranged such that the fifth lateral band segment 274R crosses the fourth lateral band segment 272F along the lateral sidewall 110L of the upper shell 110 (and along the lateral side of a wearer's foot).

A fourth lateral side foot wrapping band 276 provided in this illustrated example upper 102 structure includes: (a) a fourth lateral lace engaging element (not shown in the view of FIG. 4A but akin to element 202L) extending through the fourth lateral side opening 236O, (b) a seventh lateral band segment 276R extending from the fourth lateral lace engaging element and between the lateral sidewall 110L and the bootie component 120, wherein the seventh lateral band segment 276R is engaged with the bottom plantar support surface 110S of the upper shell 110 at a fixed bottom connection (e.g., sewn seam 130S) that is spaced inward from the outer perimeter edge 110P of the bottom plantar support surface 110S, and (c) an eighth lateral band segment 276F extending from the fourth lateral lace engaging element and between the lateral sidewall 110L and the bootie component 120, wherein the eighth lateral band segment 276F extends forward of the seventh lateral band segment 276R and is engaged with the bottom plantar support surface 110S of the upper shell 110 at a fixed bottom connection (e.g., sewn seam 130S) spaced inward from the outer perimeter edge 110P of the bottom plantar support surface 110S. In this manner, seventh lateral band segment 276R and eighth lateral band segment 276F form a "V" shaped structure (with the lace engaging element at the "V's" vertex) that wraps around a lateral side of the wearer's foot and may tighten against the foot when a lace 300 is tightened. If desired, as shown in FIG. 4A, the lateral side foot wrapping bands 274 and 276 may be arranged such that the seventh lateral band segment 276R crosses the sixth lateral band segment 274F along the lateral sidewall 110L of the upper shell 110 (and along the lateral side of a wearer's foot).

This example upper 102 structure further includes a fifth lateral side foot wrapping band 278 having: (a) a fifth lateral lace engaging element (not shown in the view of FIG. 4A but akin to element 202L) extending through the fifth lateral side opening 238O, (b) a ninth lateral band segment 278R extending from the fifth lateral lace engaging element and between the lateral sidewall 110L and the bootie component 120, wherein the ninth lateral band segment 278R is engaged with the bottom plantar support surface 110S of the upper shell 110 at a fixed bottom connection (e.g., sewn seam 130S) that is spaced inward from the outer perimeter edge 110P of the bottom plantar support surface 110S, and (c) a tenth lateral band segment 278F extending from the fifth lateral lace engaging element and between the lateral sidewall 110L and the bootie component 120, wherein the tenth lateral band segment 278F extends forward of the ninth lateral band segment 278R and is engaged with the bottom plantar support surface 110S of the upper shell 110 at a fixed bottom connection (e.g., sewn seam 130S) spaced inward from the outer perimeter edge 110P of the bottom plantar support surface 110S. In this manner, ninth lateral band segment 278R and tenth lateral band segment 278F form a "V" shaped structure (with the lace engaging element at the "V' s" vertex) that wraps around a lateral side of the wearer's foot and may tighten against the foot when a lace 300 is tightened. If desired, as shown in FIG. 4A, the lateral side foot wrapping bands 276 and 278 may be arranged such that the ninth lateral band segment 278R crosses the eighth lateral band segment 276F along the lateral sidewall 110L of the upper shell 110 (and along the lateral side of a wearer's foot).

The lateral side of the upper 102 of this specifically illustrated example further includes a rearmost lateral side foot wrapping band 280 that includes: (a) a lateral lace engaging element (not shown in the view of FIG. 4A but akin to element 202L) extending through the rearmost lateral side opening 240O; (b) a rearward extending lateral band segment 280R extending from the lateral lace engaging element and between the lateral sidewall 110L and the bootie component 120, wherein the rearward extending lateral band segment 280R is engaged with (i) a rear heel area of the bootie component 120 (see also FIG. 4F) and/or (ii) the bottom plantar support surface 110S of the upper shell 110 at a fixed bottom connection (e.g., sewn seam 130S) that is spaced inward from the outer perimeter edge 110P of the bottom plantar support surface 110S; and (c) another lateral band segment 280F extending from the lateral lace engaging element and between the lateral sidewall 110L and the bootie component 120, wherein this other lateral band segment 280F extends forward of the rearward extending lateral band segment 280R and is engaged with the bottom plantar support surface 110S of the upper shell 110 at a fixed bottom connection (e.g., sewn seam 130S) spaced inward from the outer perimeter edge 110P of the bottom plantar support surface 110S. In this manner, the lateral band segments 280R and 280F form a "V" shaped structure (with the lace engaging element at the "V' s" vertex) that wraps around a lateral side of the wearer's foot and may tighten against the foot when a lace 300 is tightened. If desired, as shown in FIG. 4A, the first lateral side foot wrapping band 270 and the rearmost foot wrapping band 280 may be arranged such that the first lateral band segment 270R crosses the lateral band segment 280F along the lateral sidewall 110L of the upper shell 110 (and along the lateral side of a wearer's foot).

As further shown in FIGS. 1A-1C, 4B, 4C, 4E, and 4F, the lace engaging elements 202L of the various foot wrapping bands (e.g., 200, 250, 252, 254, 256, 258, 260, 270, 272, 274, 276, 278, and 280) engage a shoelace 300. Pulling on the shoelace 300 tightens the foot wrapping bands (e.g., one or more of 200, 250, 252, 254, 256, 258, 260, 270, 272, 274, 276, 278, and 280) around the wearer's foot. Tightening the lace 300, together with the various features described above (e.g.: (a) the "V" shapes formed by the foot wrapping band segments, (b) the "overlapping" or "intersecting" nature of the foot wrapping band segments along the side of the wearer's foot, (c) the fixing location for the foot wrapping band segments and/or the bootie component 120 with the upper shell 110 inward from the outer perimeter edge 110P of the plantar support surface 110S (and beneath/beyond the bight line where the upper shell 110 meets the bootie component 120), and/or (d) the form fitting sock-like bootie component 120), work together to provide a secure and "locked down" feel of the upper 102 on the wearer's foot.

As noted above, in at least some examples of this invention, the upper shell 110 may include lace engaging slits or slots 222 located adjacent the side openings 210O-220O and 230O-240O through which the lace engaging element 202L of the foot wrapping bands bands (e.g., 200, 250, 252, 254, 256, 258, 260, 270, 272, 274, 276, 278, and 280) extend. FIGS. 4B-4E provide close up views of at least some of the side openings 210O-220O and 230O-240O through which the lace engaging element 202L of the foot wrapping bands (e.g., 200, 250, 252, 254, 256, 258, 260, 270, 272, 274, 276, 278, and 280) extend and the lace engaging slit or slot 222 through which the lace 300 extends. As shown, in these illustrated examples, the side opening(s) 210O-220O and 230O-240O are not continuous with its associated lace engaging slit or slot 222. In other words, in this illustrated example, a continuous portion 110V of the upper shell 110 extends between each side opening 210O-220O and 230O-240O and its associated lace engaging slit or slot 222. In this example upper 102, lace 300 passes through both slits/slots 222 of the upper shell 110 and the lace engaging elements 202L of the foot wrapping bands 250, 252, 254, 256, 258, 260, 270, 272, 274, 276, 278, and 280. The slits/slots 222 are located closer to their respective lateral edge 204L and medial edge 204M of the lace engaging region 204 of the upper shell 110 than are the respective side openings 210O-220O and 230O-240O (e.g., the openings 210O-220O and 230O-240O are located closer to a bottom edge of the upper shell 110 than are their respective slits/slots 222).

If desired, as best shown perhaps in FIG. 4D, the edges of the side opening(s) 210O-220O and/or 230O-240O and/or lace engaging slits or slots 222 formed in the upper shell 110 may include a reinforcing structure 110R, e.g., to prevent undesired tearing of the upper 102 and/or upper shell 110 material when the lace 300 is tightened or the upper 102 is otherwise stressed. This reinforcement 110R may constitute a coating or other wear resistant and/or tear resistant material, e.g., applied around the opening(s) and/or slit(s), such as a TPU or other tear resistant polymeric material. In use, the lace 300 extends through the slits/slots 222 and through the lace engaging element 202L extending through the side openings 210O-220O and 230O-240O and may be used to tighten the footwear 100 to the wearer's foot while reinforcements 110R prevent tearing of the upper shell 110, e.g., when the lace 300 is tightened.

FIGS. 4B-4D further illustrate that the lace engaging slits or slots 222 in this illustrated example are generally oriented transverse to its respective lace engaging edge of the upper shell 110 (e.g., transverse to the medial side edge 204M or the lateral side edge 204L of the lace engaging region 204) and/or generally parallel to the forward edge 204F of the lace engaging region 204. Also, as shown in these figures, the slits/slots 222 generally extend in a side-to-side and/or top-to-bottom direction of the upper 102 (and not in a heel-to-toe direction). In this manner, the lace 300 can move upward and/or downward and/or sideways in the slit or slot 222 as the lace 300 is tightened. These features can help assure that the lace 300 better engages and pulls the lace engaging elements 202L of the foot wrapping bands (e.g., 200, 250, 252, 254, 256, 258, 260, 270, 272, 274, 276, 278, and/or 280), thereby better tightening the foot wrapping bands around the wearer's foot (providing better support, a better "locked down" feel, etc.).

Figure 4G:
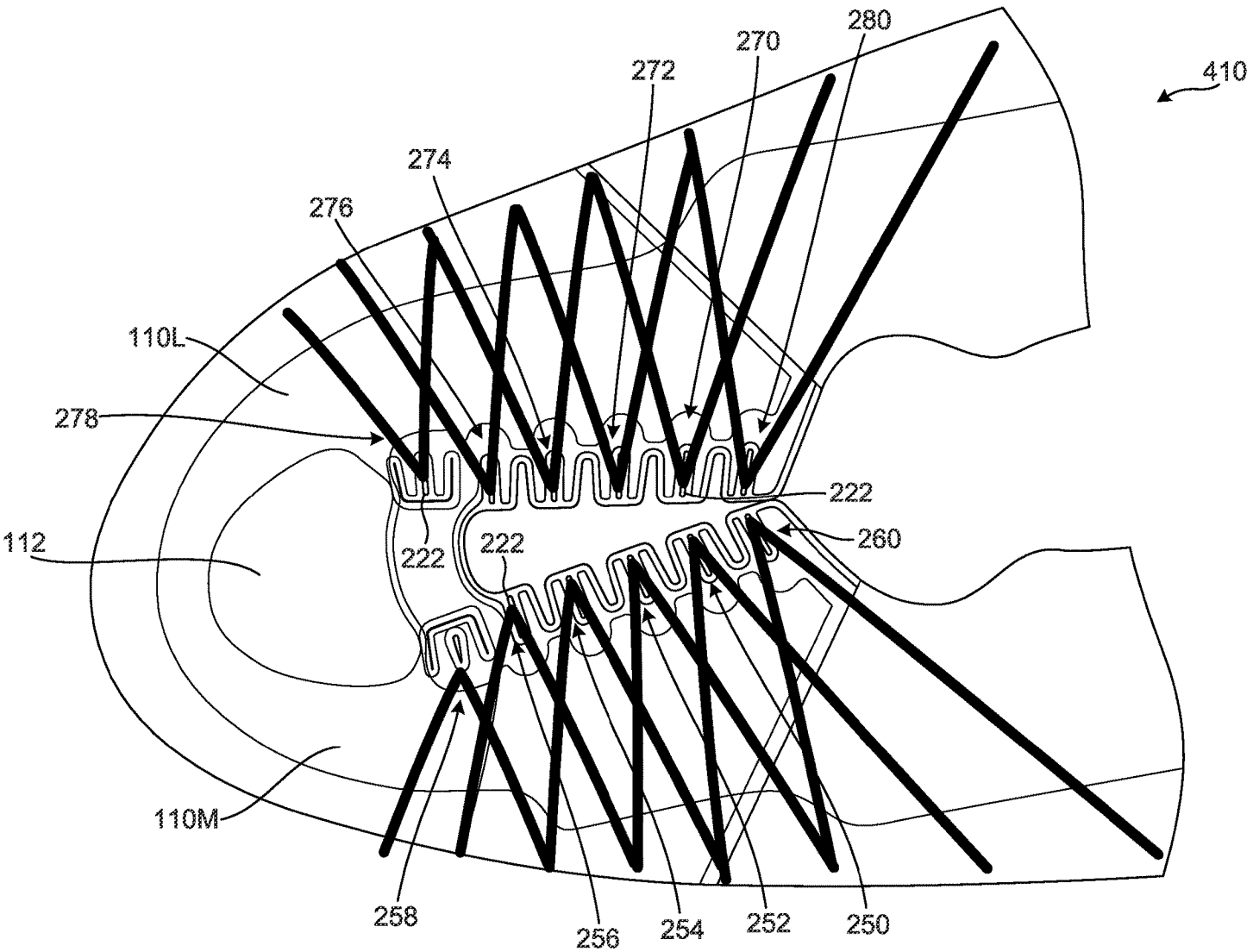

FIG. 4G shows another example upper shell 410 with foot wrapping bands (250, 252, 254, 256, 258, 260, 270, 272, 274, 276, 278, and/or 280) associated with it similar to the structure shown in FIG. 4A. When the same reference numbers are used in FIG. 4G as used in the other figures described above, the same or a similar part is intended, and a more detailed description of the same or similar parts may be omitted. In the upper shell 410 of FIG. 4G, however, the side openings 210O-220O and 230O-240O are omitted as compared to the upper shell 110 shown in FIG. 4A. Rather, the lace engaging element(s) 202L of the foot wrapping band(s) 250, 252, 254, 256, 258, 260, 270, 272, 274, 276, 278, and/or 280 extend through the slits/slots 222, and the lace 300 can directly engage the lace engaging element(s) 202L of the foot wrapping band(s) 250, 252, 254, 256, 258, 260, 270, 272, 274, 276, 278, and/or 280 without directly extending through the slits/slots 222 (i.e., in this upper shell 410, the lace 300 does not extend through slits/slots 222). The foot wrapping band(s) 250, 252, 254, 256, 258, 260, 270, 272, 274, 276, 278, and/or 280 can move upward and/or downward and/or sideways in the slit/slot 222 as the lace 300 is tightened. These features can help assure that the lace 300 better engages and pulls the lace engaging elements 202L of the foot wrapping bands (e.g., 200, 250, 252, 254, 256, 258, 260, 270, 272, 274, 276, 278, and/or 280), thereby better tightening the foot wrapping bands around the wearer's foot (providing better support, a better "locked down" feel, etc.).

III. Conclusion

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. An article of footwear, comprising:

an exterior upper component including a lace-engaging region having a medial side edge and a lateral side edge, wherein the exterior upper component at least in part defines an interior chamber configured to receive a wearer's foot, and wherein:

a first medial lace engaging slot is defined through the exterior upper component at a first medial location along the medial side edge of the lace-engaging region, a first medial side opening is defined through the exterior upper component along the medial side edge of the lace-engaging region and adjacent the first medial lace engaging slot, a first lateral lace engaging slot is defined through the exterior upper component at a first lateral location along the lateral side edge of the lace-engaging region, and a first lateral side opening is defined through the exterior upper component along the lateral side edge of the lace-engaging region and adjacent the first lateral lace engaging slot;

a plantar support component engaged with the exterior upper component;

a first medial side foot wrapping band fixed to the plantar support component and extending inside the interior chamber defined at least in part by the exterior upper component toward the medial side edge of the lace-engaging region, wherein the first medial side foot wrapping band extends through the first medial side opening and includes a first medial lace engaging element;

a first lateral side foot wrapping band fixed to the plantar support component and extending inside the interior chamber defined at least in part by the exterior upper component toward the lateral side edge of the lace-engaging region, wherein the first lateral side foot wrapping band extends through the first lateral side opening and includes a first lateral lace engaging element; and a lace engaging the first medial lace engaging slot, the first medial lace engaging element, the first lateral lace engaging slot, and the first lateral lace engaging element, wherein the lace, the first medial lace engaging slot, and the first lateral lace engaging slot are configured such that the lace is capable of moving upward and/or downward in the first medial lace engaging slot and in the first lateral lace engaging slot, and wherein the lace extends: (i) through the first medial lace engaging slot, from the first medial lace engaging slot directly to and through the first medial lace engaging element, and (ii) through the first lateral lace engaging slot, from the first lateral lace engaging slot directly to and through the first lateral lace engaging element.

2. The article of footwear according to claim 1, wherein a longest direction of the first medial lace engaging slot is oriented transverse to the medial side edge of the lace-engaging region, wherein the first medial side opening is spaced from and located adjacent a bottom end of the first medial lace engaging slot, wherein a longest direction of the first lateral lace engaging slot is oriented transverse to the lateral side edge of the lace-engaging region, and wherein the first lateral side opening is spaced from and located adjacent a bottom end of the first lateral lace engaging slot.

3. The article of footwear according to claim 1, wherein the first medial lace engaging slot is oriented to extend in a top-to-bottom direction of the exterior upper component, wherein the first medial side opening is spaced from and located adjacent a bottom end of the first medial lace engaging slot, wherein the first lateral lace engaging slot is oriented to extend in the top-to-bottom direction of the exterior upper component, and wherein the first lateral side opening is spaced from and located adjacent a bottom end of the first lateral lace engaging slot.

4. The article of footwear according to claim 1, wherein the first medial lace engaging slot includes a first medial reinforcing structure, and wherein the first lateral lace engaging slot includes a first lateral reinforcing structure.

5. The article of footwear according to claim 1, wherein the plantar support component comprises a strobel member.

6. The article of footwear according to claim 1, wherein the exterior upper component further includes: (i) a second medial lace engaging slot defined through the exterior upper component at a second medial location along the medial side edge of the lace-engaging region, and (ii) a second lateral lace engaging slot defined through the exterior upper component at a second lateral location along the lateral side edge of the lace-engaging region, wherein the article of footwear further comprises:

a second medial side foot wrapping band fixed to the plantar support component and extending inside the interior chamber defined at least in part by the exterior upper component toward the medial side edge of the lace-engaging region, wherein the second medial side foot wrapping band includes a second medial lace engaging element; and a second lateral side foot wrapping band fixed at the plantar support component and extending inside the interior chamber defined at least in part by the exterior upper component toward the lateral side edge of the lace-engaging region, wherein the second lateral side foot wrapping band includes a second lateral lace engaging element, and wherein the lace additionally engages the second medial lace engaging slot, the second medial lace engaging element, the second lateral lace engaging slot, and the second lateral lace engaging element.

7. The article of footwear according to claim 1, wherein the exterior upper component and the plantar support component comprise portions of a footwear upper, and wherein the article of footwear further comprises an interior midsole component formed from a polymer foam material removably received in the interior chamber.

8. The article of footwear according to claim 1, wherein the exterior upper component and the plantar support component comprise portions of a footwear upper, wherein the article of footwear further comprises an interior midsole component located in the interior chamber, wherein the interior midsole component has a thickness measured directly from a top surface of the interior midsole component to a bottom surface of the interior midsole component, and wherein the thickness is at least 9 mm through at least 70% of the top surface.

9. The article of footwear according to claim 8, wherein the interior midsole component includes raised outer edges.

10. The article of footwear according to claim 1, wherein the exterior upper component includes a top panel extending over an instep and/or forefoot containing area of the article of footwear.

11. An article of footwear, comprising:

an upper formed from one or more component parts, the upper including a plantar support component, a medial sidewall, a lateral sidewall, and a lace-engaging region having a medial side edge and a lateral side edge, wherein the upper at least in part defines an interior chamber configured to receive a wearer's foot, and wherein:

a first medial lace engaging slot is defined through the medial sidewall at a first medial location along the medial side edge of the lace-engaging region, a first medial side opening is defined through the medial sidewall adjacent the first medial lace engaging slot, a first lateral lace engaging slot is defined through the lateral sidewall at a first lateral location along the lateral side edge of the lace-engaging region, and a first lateral side opening is defined through the lateral sidewall adjacent the first lateral lace engaging slot;

a first medial side foot wrapping band fixed to the plantar support component and extending inside the interior chamber defined at least in part by the upper and inside the medial sidewall toward the medial side edge of the lace-engaging region, wherein the first medial side foot wrapping band extends through the first medial side opening and includes a first medial lace engaging element;

a first lateral side foot wrapping band fixed to the plantar support component and extending inside the interior chamber defined at least in part by the upper and inside the lateral sidewall toward the lateral side edge of the lace-engaging region, wherein the first lateral side foot wrapping band extends through the first lateral side opening and includes a first lateral lace engaging element; and a lace engaging the first medial lace engaging slot, the first medial lace engaging element, the first lateral lace engaging slot, and the first lateral lace engaging element, wherein the lace, the first medial lace engaging slot, and the first lateral lace engaging slot are configured such that the lace is capable of moving upward and/or downward in the first medial lace engaging slot and in the first lateral lace engaging slot, and wherein the lace extends: (i) through the first medial lace engaging slot, from the first medial lace engaging slot directly to and through the first medial lace engaging element, and (ii) through the first lateral lace engaging slot, from the first lateral lace engaging slot directly to and through the first lateral lace engaging element.

12. The article of footwear according to claim 11, wherein a longest direction of the first medial lace engaging slot is oriented transverse to the medial side edge of the lace-engaging region, wherein the first medial side opening is spaced from and located adjacent a bottom end of the first medial lace engaging slot, wherein a longest direction of the first lateral lace engaging slot is oriented transverse to the lateral side edge of the lace-engaging region, and wherein the first lateral side opening is spaced from and located adjacent a bottom end of the first lateral lace engaging slot.

13. The article of footwear according to claim 11, wherein the first medial lace engaging slot is oriented to extend in a top-to-bottom direction of the upper, wherein the first medial side opening is spaced from and located adjacent a bottom end of the first medial lace engaging slot, wherein the first lateral lace engaging slot is oriented to extend in the top-to-bottom direction of the upper, and wherein the first lateral side opening is spaced from and located adjacent a bottom end of the first lateral lace engaging slot.

14. The article of footwear according to claim 11, wherein the first medial lace engaging slot includes a first medial reinforcing structure, and wherein the first lateral lace engaging slot includes a first lateral reinforcing structure.

15. The article of footwear according to claim 11, wherein the plantar support component comprises a strobel member.

16. The article of footwear according to claim 11, wherein the upper further includes: (i) a second medial lace engaging slot defined through the medial sidewall at a second medial location along the medial side edge of the lace-engaging region, and (ii) a second lateral lace engaging slot defined through the lateral sidewall at a second lateral location along the lateral side edge of the lace-engaging region, wherein the article of footwear further comprises:

a second medial side foot wrapping band fixed to the plantar support component and extending inside the interior chamber defined at least in part by the upper and inside the medial sidewall toward the medial side edge of the lace-engaging region, wherein the second medial side foot wrapping band includes a second medial lace engaging element; and a second lateral side foot wrapping band fixed at the plantar support component and extending inside the interior chamber defined at least in part by the upper and inside the lateral sidewall toward the lateral side edge of the lace-engaging region, wherein the second lateral side foot wrapping band includes a second lateral lace engaging element, and wherein the lace additionally engages the second medial lace engaging slot, the second medial lace engaging element, the second lateral lace engaging slot, and the second lateral lace engaging element.

17. The article of footwear according to claim 11, further comprising an interior midsole component formed from a polymer foam material removably received in the interior chamber.

18. The article of footwear according to claim 11, further comprising an interior midsole component located in the interior chamber, wherein the interior midsole component has a thickness measured directly from a top surface of the interior midsole component to a bottom surface of the interior midsole component, and wherein the thickness is at least 9 mm through at least 70% of the top surface.

19. The article of footwear according to claim 18, wherein the interior midsole component includes raised outer edges.

20. The article of footwear according to claim 11, wherein the upper further includes a top panel extending over an instep and/or forefoot containing area of the article of footwear.

* * * * *